US007744390B2

(12) United States Patent
Tyler et al.

(10) Patent No.: US 7,744,390 B2
(45) Date of Patent: Jun. 29, 2010

(54) ELECTRICAL CONNECTOR ASSEMBLY WITH CONNECTION ASSIST

(75) Inventors: Adam P. Tyler, Rochester Hills, MI (US); Jeffrey S. Campell, West Bloomfield, MI (US); Franklin A. Holub, West Bloomfield, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/002,608

(22) Filed: Dec. 18, 2007

(65) Prior Publication Data

US 2008/0132098 A1 Jun. 5, 2008

Related U.S. Application Data

(63) Continuation-in-part of application No. 11/803,566, filed on May 14, 2007, now Pat. No. 7,462,047, which is a continuation of application No. 11/445,975, filed on Jun. 1, 2006, now Pat. No. 7,241,155.

(60) Provisional application No. 60/704,232, filed on Jul. 28, 2005.

(51) Int. Cl.
*H01R 13/62* (2006.01)

(52) U.S. Cl. ..... 439/157; 439/372

(58) Field of Classification Search ..... 439/188, 439/153, 157, 372

See application file for complete search history.

(56) References Cited

U.S. PATENT DOCUMENTS

| | | | | |
|---|---|---|---|---|
| 3,495,206 | A | 2/1970 | Pfister | 339/64 |
| 4,332,432 | A | 6/1982 | Colleran | 439/157 |
| 4,684,190 | A | 8/1987 | Clark et al. | 439/587 |
| 4,778,395 | A | 10/1988 | Narita | 439/71 |
| 5,026,296 | A | 6/1991 | Hashiguchi | 439/159 |
| 5,110,301 | A | 5/1992 | Inoue et al. | 439/310 |
| 5,112,154 | A | 5/1992 | Milam | 403/13 |
| 5,171,156 | A | 12/1992 | Nagasaka et al. | 439/157 |
| 5,230,635 | A | 7/1993 | Takenouchi et al. | 439/157 |
| 5,244,400 | A | 9/1993 | Hatagishi | 439/157 |
| 5,269,696 | A | 12/1993 | Okada et al. | 439/140 |
| 5,279,506 | A | 1/1994 | Kawase et al. | 439/157 |
| 5,489,224 | A | 2/1996 | Schwarz | 439/752 |

(Continued)

FOREIGN PATENT DOCUMENTS

| | | | |
|---|---|---|---|
| JP | 2005-174681 | A | 6/2005 |

(Continued)

OTHER PUBLICATIONS

Patent Abstract for JP 2006-278109A.

*Primary Examiner*—Thanh-Tam T Le
(74) *Attorney, Agent, or Firm*—Harrington & Smith

(57) ABSTRACT

An electrical connector including a housing; a slide slidably mounted to the housing, wherein the slide comprises a rack section with teeth; a cam member and a connector position assurance (CPA) member. The cam member is rotatably mounted to the housing. The cam member comprises a camming surface adapted to contact a cam portion of a mating electrical connector. The cam member comprises a gear section with teeth engaging the teeth of the slide. The CPA member is movably connected to the housing. The CPA member is adapted to directly engage the cam member for preventing the cam member for rotating relative to the housing.

20 Claims, 28 Drawing Sheets

U.S. PATENT DOCUMENTS

| | | | | |
|---|---|---|---|---|
| 5,564,935 | A | 10/1996 | Yagi et al. | 439/157 |
| 5,628,642 | A | 5/1997 | Bieringer et al. | 439/157 |
| 5,829,994 | A * | 11/1998 | Oda et al. | 439/157 |
| 5,873,745 | A | 2/1999 | Duclos et al. | 439/157 |
| 5,921,791 | A | 7/1999 | Ono et al. | 439/157 |
| 5,924,880 | A | 7/1999 | Watanabe et al. | 439/157 |
| 5,928,012 | A * | 7/1999 | Kitamura | 439/157 |
| 5,928,038 | A | 7/1999 | Berg et al. | 439/752 |
| 5,944,547 | A | 8/1999 | Golab et al. | 429/188 |
| 5,954,528 | A | 9/1999 | Ono et al. | 439/157 |
| 5,975,929 | A | 11/1999 | Matsuura et al. | 439/157 |
| 6,036,510 | A * | 3/2000 | Ono et al. | 439/157 |
| 6,048,229 | A | 4/2000 | Lazaro, Jr. | 439/681 |
| 6,095,833 | A | 8/2000 | Osawa | 439/157 |
| 6,120,308 | A | 9/2000 | Hayashi | 439/157 |
| 6,126,470 | A | 10/2000 | Ono | 439/310 |
| 6,305,990 | B1 | 10/2001 | Ward | 439/752 |
| 6,352,433 | B2 | 3/2002 | Hayashi | 439/34 |
| 6,361,378 | B1 | 3/2002 | Konoya et al. | 439/752 |
| 6,371,778 | B1 * | 4/2002 | Watanabe | 439/157 |
| 6,375,481 | B2 * | 4/2002 | Zweigle | 439/157 |
| 6,428,353 | B2 * | 8/2002 | Mochizuki | 439/545 |
| 6,475,004 | B2 | 11/2002 | Shuey et al. | 439/157 |
| 6,514,098 | B2 | 2/2003 | Marpoe, Jr. et al. | 439/352 |
| 6,599,153 | B2 | 7/2003 | Nishide | 439/681 |
| 6,612,854 | B2 | 9/2003 | Takata | 439/157 |
| 6,705,882 | B2 | 3/2004 | Casses | 439/157 |
| 6,793,522 | B2 * | 9/2004 | Yamashita | 439/489 |
| 6,960,090 | B2 | 11/2005 | Denter et al. | 439/157 |
| 6,997,725 | B2 | 2/2006 | Stella et al. | 439/157 |
| 7,241,155 | B2 * | 7/2007 | Tyler et al. | 439/157 |
| 2001/0012710 | A1 | 8/2001 | Kumakura et al. | 439/157 |
| 2002/0022391 | A1 | 2/2002 | Beck, Jr. et al. | 439/157 |
| 2002/0081877 | A1 | 6/2002 | Ohnuki | 439/157 |
| 2002/0127912 | A1 | 9/2002 | Hamai et al. | 439/587 |
| 2002/0182908 | A1 | 12/2002 | Maegawa | 439/157 |
| 2003/0003786 | A1 | 1/2003 | Bakker et al. | 439/157 |
| 2004/0192090 | A1 | 9/2004 | Flowers et al. | 439/157 |

FOREIGN PATENT DOCUMENTS

| | | |
|---|---|---|
| JP | 2006-278109 A | 12/2006 |

* cited by examiner

ELECTRICAL CONNECTOR ASSEMBLY WITH CONNECTION ASSIST

CROSS REFERENCE TO RELATED APPLICATION

This application is a continuation-in-part patent application of U.S. patent application Ser. No. 11/803,566 filed May 14, 2007 now U.S. Pat. No. 7,462,047, which is a continuation patent application of U.S. patent application Ser. No. 11/445,975 filed Jun. 1, 2006, now U.S. Pat. No. 7,241,155, which claims priority under 35 U.S.C. §119(e) on U.S. provisional patent application No. 60/704,232 filed Jul. 28, 2005 which are hereby incorporated by reference in their entireties.

BACKGROUND OF THE INVENTION

1. Field of the Invention

The invention relates to an electrical connector and, more particularly, to a system for mating two electrical connectors with each other.

2. Brief Description of Prior Developments

U.S. Pat. No. 6,120,308 discloses an electrical connector assembly which can be rotatably connected and disconnected.

SUMMARY OF THE INVENTION

In accordance with one aspect of the invention, an electrical connector is provided including a housing; a slide slidably mounted to the housing, wherein the slide comprises a rack section with teeth; a cam member and a connector position assurance (CPA) member. The cam member is rotatably mounted to the housing. The cam member comprises a caming surface adapted to contact a cam portion of a mating electrical connector. The cam member comprises a gear section with teeth engaging the teeth of the slide. The CPA member is movably connected to the housing. The CPA member is adapted to directly engage the cam member for preventing the cam member for rotating relative to the housing.

In accordance with another aspect of the invention, an electrical connector slide member is provided comprising a main housing section, a rack section, a first latch and a second latch. The main housing section has a general ring shape with a central channel adapted to receive a housing of an electrical connector therein. The rack section comprises teeth on the main section at the central channel. The first latch comprises a first deflectable cantilevered arm extending into the central channel in a first direction. The second latch comprises a second deflectable cantilevered arm extending into the central channel in a second direction.

In accordance with another aspect of the invention, an electrical connector is provided comprising a housing, a slide and a cam member. The slide is movably mounted to the housing. The slide comprises a section with teeth. The cam member is rotatably mounted to the housing. The cam member comprises a caming surface adapted to contact a cam portion of a mating electrical connector. The cam member comprises a gear section with teeth engaging the teeth of the slide. The cam member comprises a connector position assurance (CPA) slot adapted to receive a portion of a CPA member in the CPA slot.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
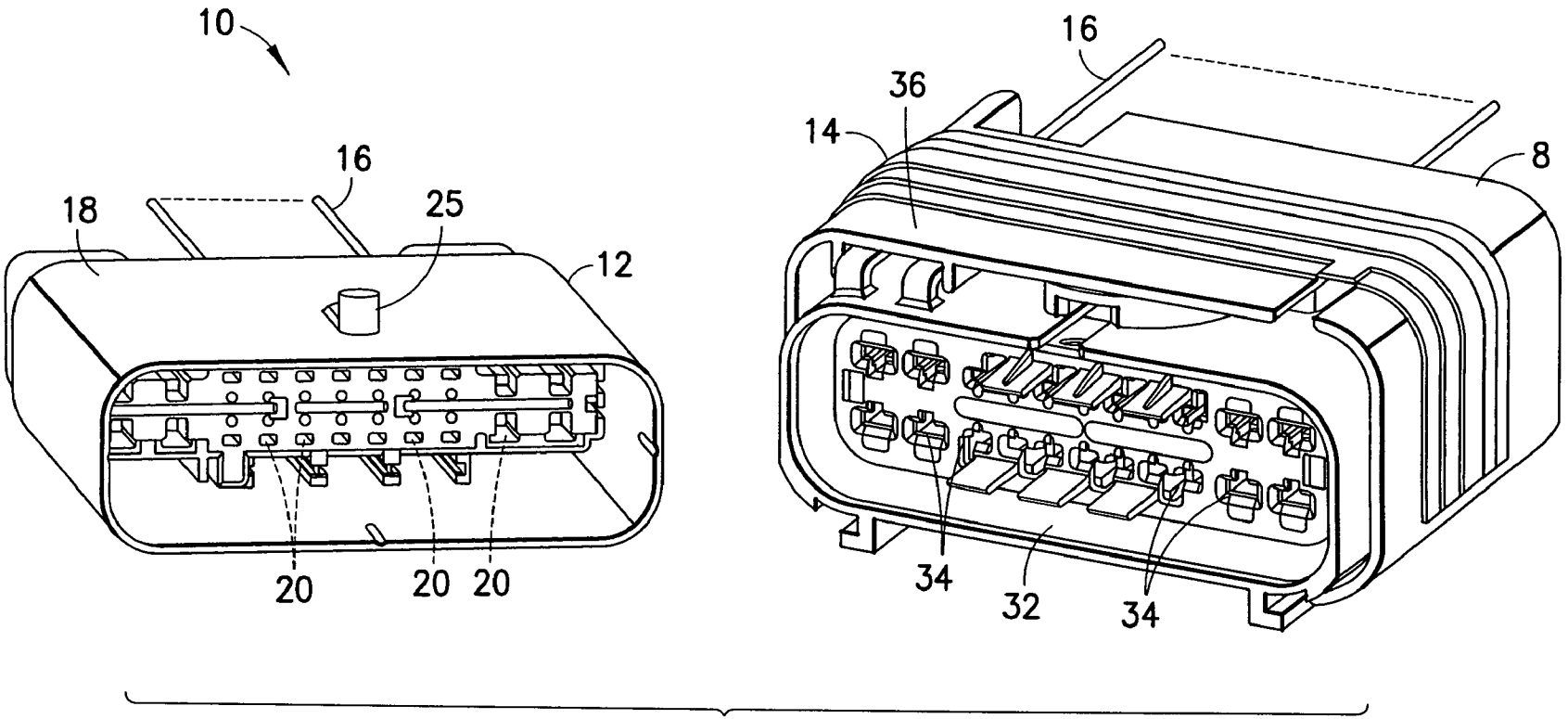
FIG. 1 is an exploded perspective view of two electrical connectors used to form an electrical connector assembly.

Referring to FIG. 1, there is shown an exploded perspective view of an electrical connector assembly 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The assembly 10 generally comprises a first electrical connector 12, a second electrical connector 14 and electrical conductors 16, such as wires, connected to the electrical connectors 12, 14. The two electrical connectors 12, 14 are adapted to removably mate with each other to electrically connected their respective wires 16 to each other. The first electrical connector 12 generally comprises a housing 18, electrical contacts 20 and a mat wire seal 27 (see FIGS. 2A and 2B). The mat wire seal 27 forms seals and strain relief for the wires 16 entering the rear of the connector 12. The seal 27 is located between the rear end of the outer housing member 24 and the rear end of the inner housing member 22. The seal has holes to allow wires to pass through the seal and which makes a sealing contact with the wires.

Figure 2:
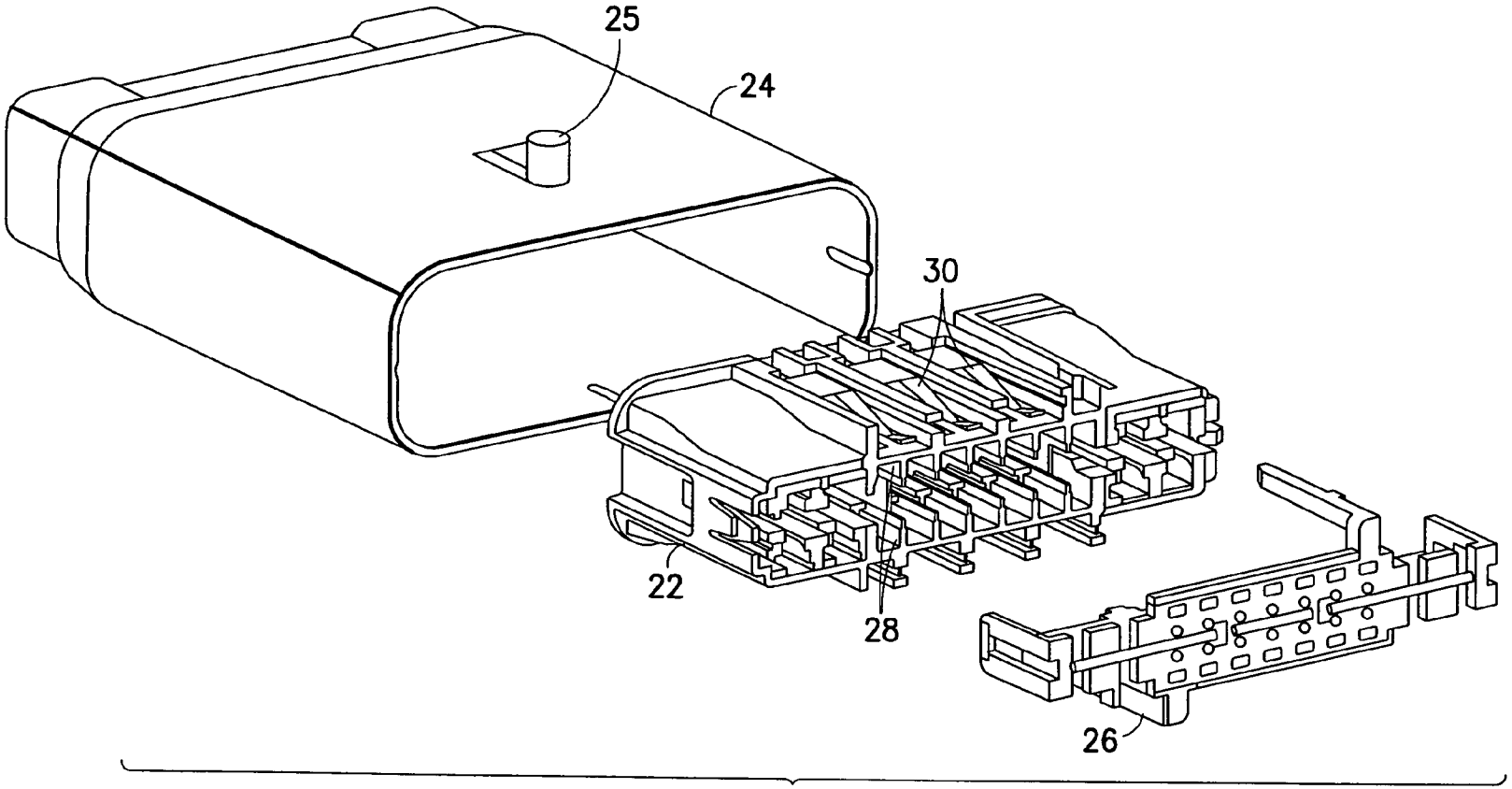
FIG. 2 is an exploded perspective view of some components of a first one of the electrical connectors shown in FIG. 1.

Referring also to FIG. 2, the housing 18 generally comprises an inner housing member 22, an outer housing member 24, and a combined terminal position assurance (TPA) and primary lock reinforcement (PLR) (TPA/PLR) member 26. The electrical contacts 20 are mounted in contact receiving channels 28 inside the inner housing member 22. The contacts 20 are crimped or otherwise connected to the wires 16 of the first connector 12. The inner housing member 22 is stationarily mounted inside the outer housing member 24. The TPA/PLR member 26 is movably mounted on the front end of the inner housing member 22. The inner housing 22 has locking latches at the receiving channels 28 for latching the electrical contacts 20 in the receiving channels 28. After the electrical contacts 20 are inserted into the receiving channels 28 of the inner connector housing 22, the TPA/PLR member 26 is pushed rearward on the inner housing 22 to reinforce the electrical contact locking latches. However, in alternate embodiments any suitable type of inner housing could be provided and any suitable type of terminal position assurance and primary lock reinforcement could be provided.

Figure 3:
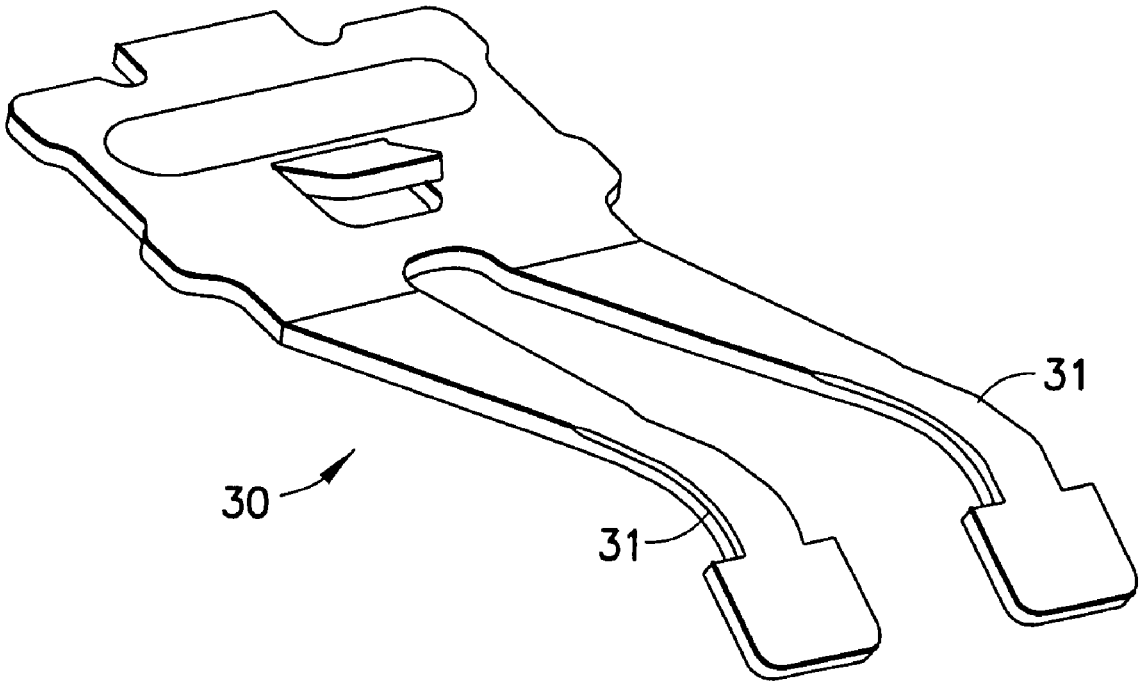
FIG. 3 is a perspective view of the shoring bar used in the connector shown in FIG. 2.

Referring also to FIG. 3, the first connector 12 includes electrical shorting bar contacts 30 mounted on the inner housing member 22. The shorting bar contacts electrically connect pairs of the electrical connectors 20 to each other before the second connector 14 is mated with the first connector 12. However, during mating of the second connector 14 with the first connector 12, the second connector 14 has projections 44 which are adapted to move the contact arms 31 of the shorting bar contacts 30 off of connection with the contacts 20. In an alternate embodiment the shorting bars might not be provided.

Figure 2A:
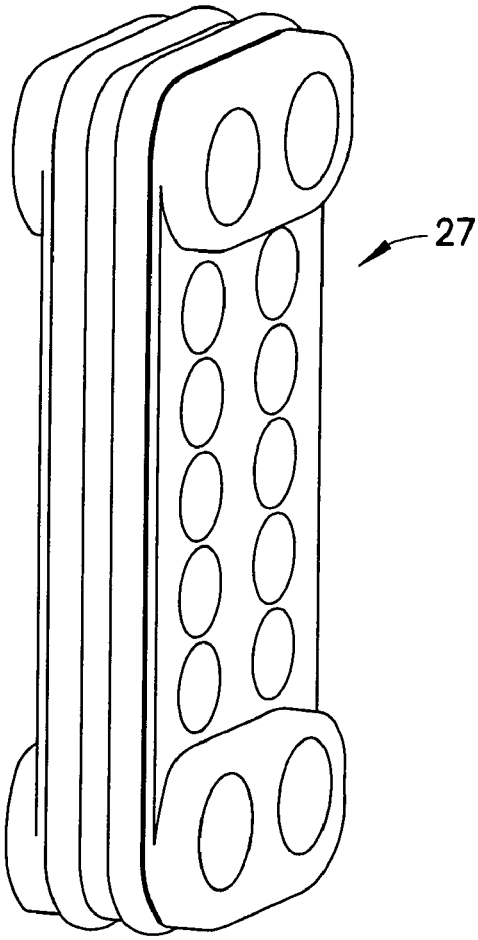
FIG. 2A is a perspective view of a mat wire seal used in the electrical connector shown in FIG. 2.
Figure 2B:
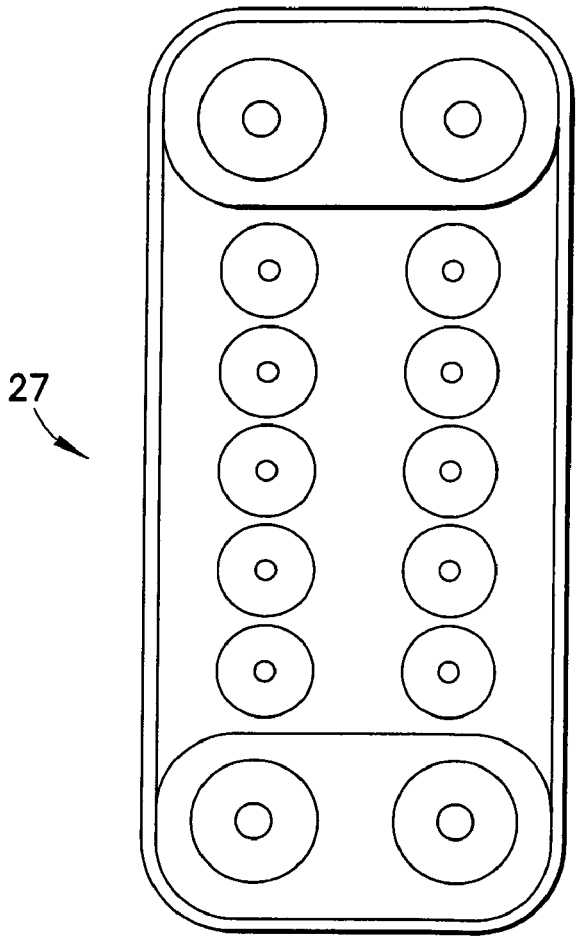
FIG. 2B is a front elevational view of the mat wire seal shown in FIG. 2A.
Figure 4:
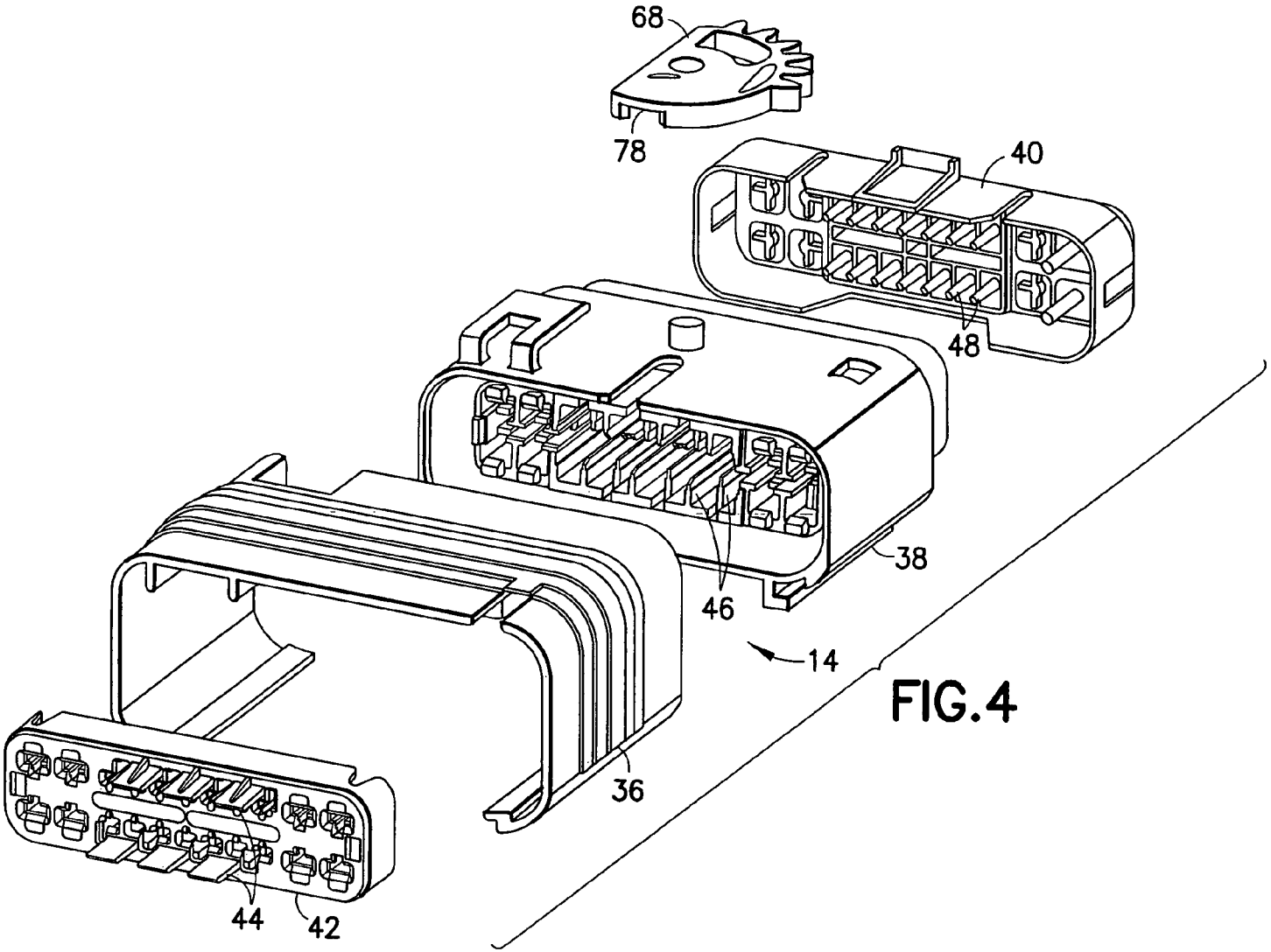
FIG. 4 is an exploded perspective view of some components of the second electrical connector shown in FIG. 1.

As seen in FIG. 1, the second electrical connector generally comprises a housing 32, electrical contacts 34 and a slide 36. Referring also to FIG. 4, the housing 32 generally comprises a main housing member 38, a rear end seal cover 40 and a front end combined terminal position assurance (TPA) and primary lock reinforcement (PLR) (TPA/PLA) member 42. The TPA/PLR member 42 is mounted to the front end of the main housing member 38, such as with a snap lock connection for example. The TPA/PLR member 42 includes forward projecting isolators 44 which are adapted to move the contact arms 31 of the shorting bar contacts 30 off of connection with the contacts 20 when the second electrical connector 14 is connected to the first electrical connector 12. A mat wire seal (not shown) similar to the seal 27 shown in FIGS. 2A and 2B is located between the rear end of the main housing member 38 and the rear end seal cover 40. A perimeter seal (not shown) is also provided on the second connector 14 to form a seal with the housing of the first connector 12. However, in alternate embodiments, any suitable structure(s) could be provided for the housing component(s) of the second connector 14.

Figure 5:
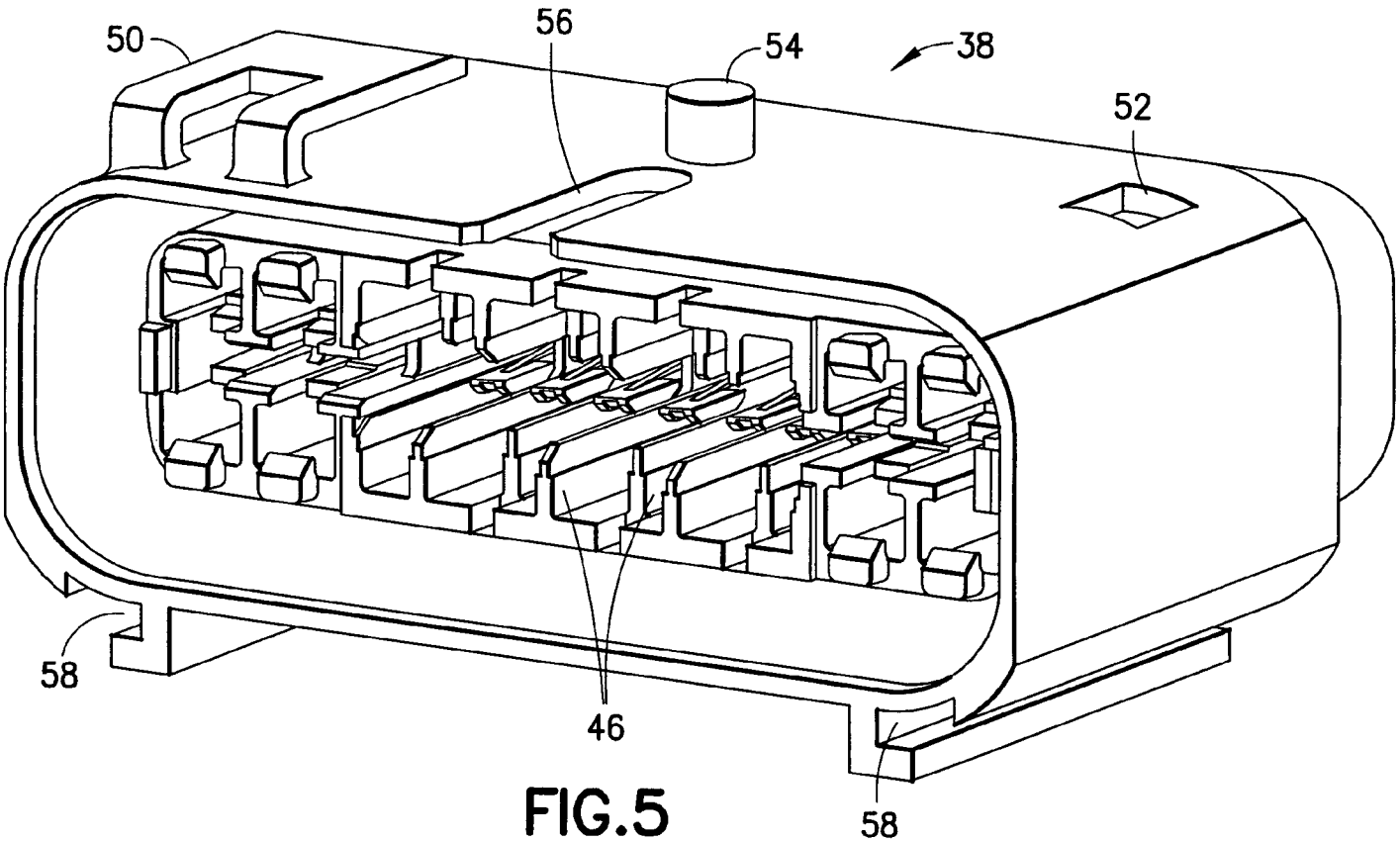
FIG. 5 is a perspective view of a main housing member of the connector shown in FIG. 4.

Referring also to FIG. 5, the main housing member 38 comprises contact receiving areas 46. The electrical contacts 34 are mounted in the receiving areas 46. The main housing member 38 comprises latches for latching the contacts 34 in the receiving areas 46. The TPA/PLR member 42, when moved to a locked position on the main housing member 38, strengthens the latches to prevent inadvertent withdrawal of the contacts 34 from the main housing member 38. A top side of the main housing member 38 comprises a first deflectable latch 50, a second latch receptacle 52, a pivot pin 54 and a slot 56. The bottom side of the main housing member 38 comprises two slide slots 58.

The rear end seal cover 40 is mounted to the rear end of the main housing member 38, such as with a snap lock connection for example. The rear seal cover 40 includes wire strain relief tubes 48. The wires 16 of the second connector 14 extend through the wire strain relief tubes 48 of the rear seal cover 40 and into the receiving areas 46.

Figure 6:
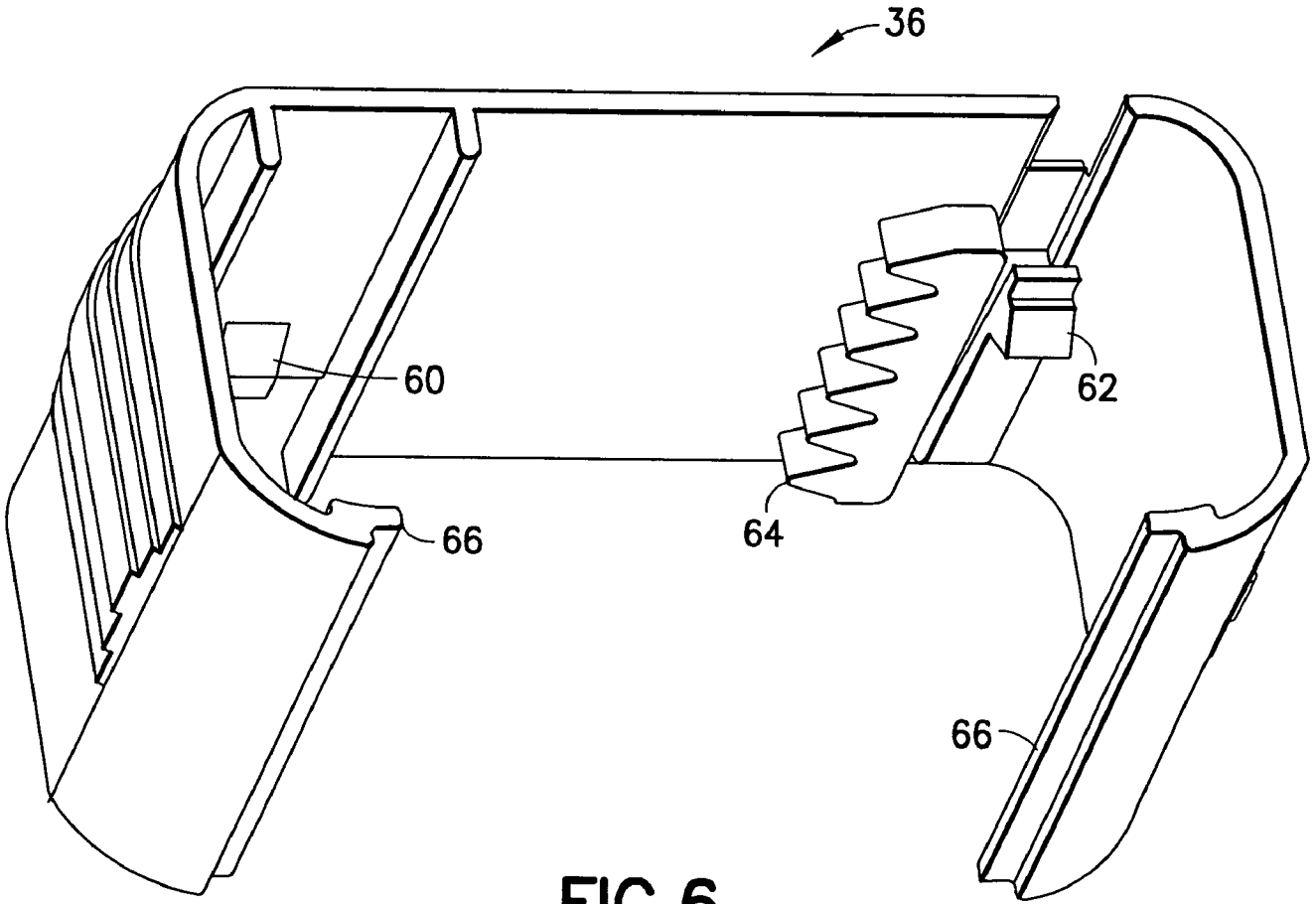
FIG. 6 is a perspective view of the slide of the connector shown in FIG. 4.

Referring also to FIG. 6, the slide 36 comprises a top with a first latch 60, a second latch 62, and a rack of teeth 64 located on the interior facing side of the top. The bottom of the slide 36 has slide feet 66. The feet 66 are sized and shaped to be received in the slide slots 58 of the main housing member 38 and slide therealong. The slide 36 is sized and shaped to be mounted over and substantially surround the main housing member 38. The slide 36 can slide along the main housing member between a rear position and a forward position.

When the slide is moved to the forward position by a user, the first latch 60 is adapted to latch with the first deflectable latch 50 to retain the slide 36 at a forward position on the main housing member 38. Thus, the first latch 60 and the first deflectable latch 50 form a first latch system. The second latch 62 is adapted to engage the second latch receptacle 52 to retain the slide 36 at the retracted rear position on the main housing member 38 until positively moved by a user. Thus, the second latch 62 and the second latch receptacle 52 form a second latch system.

Figure 7:
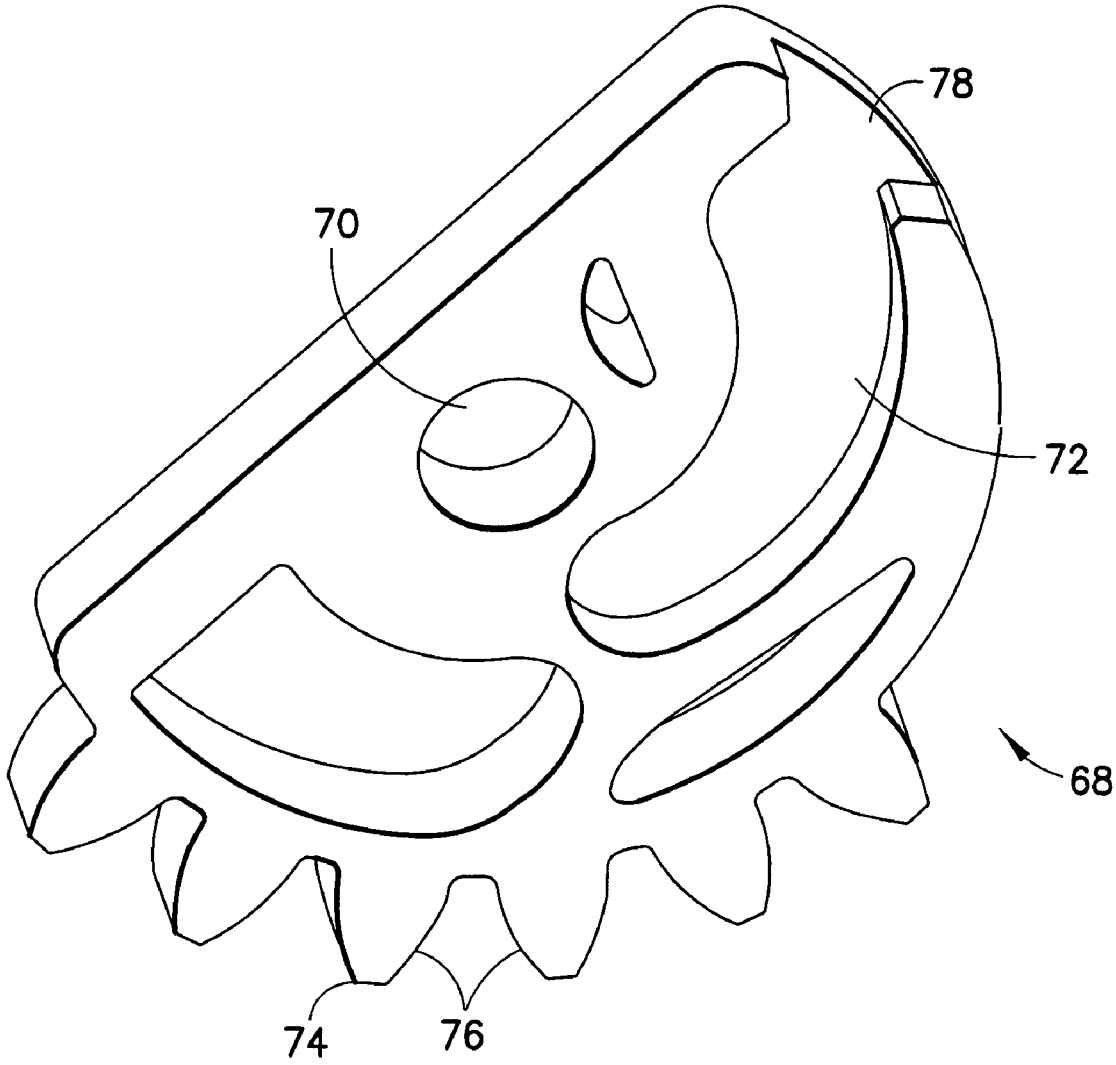
FIG. 7 is a perspective view of the combined pinion gear and cam member shown in FIG. 4.
Figure 8:
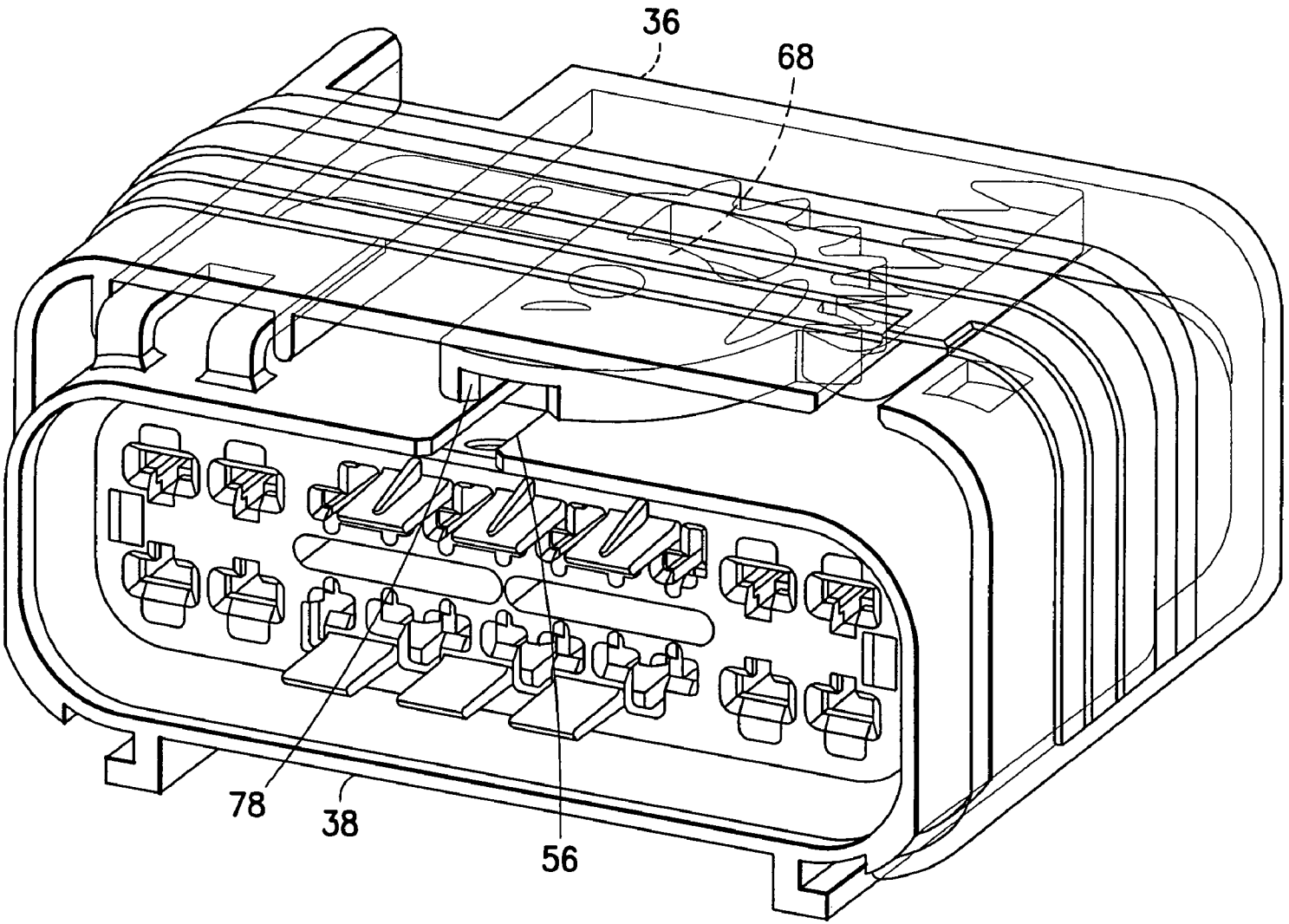
FIG. 8 is a perspective view of the connector shown in FIG. 4 with the slide in a rearward position.
Figure 10:
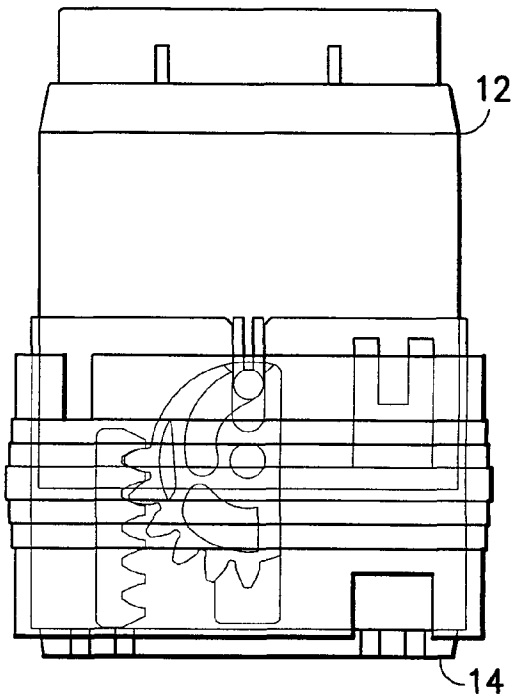
FIG. 10 is a top plan view as in FIG. 9 with the two connectors initially connected to each other.
Figure 9:
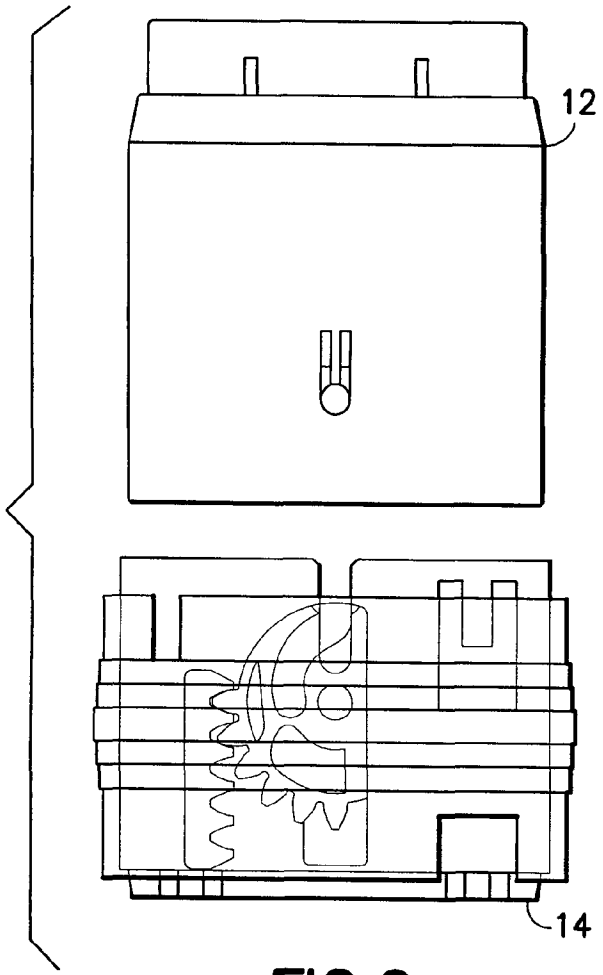
FIG. 9 is a top plan view of the two connectors shown in FIG. 1 about to be connected to each other.

Referring also to FIGS. 7 and 8, the second connector 14 also comprises a combined pinion gear and cam member 68. FIG. 8 shows the slide 36 at its rear home position. FIG. 8 also shows the member 68 at its corresponding home position. The member 68 comprises a pivot hole 70, a pin slot 72, and a gear section 74 with teeth 76. The member 68 is rotatably mounted on the main housing member 38 with the pivot pin 54 located in the pivot hole 70. The teeth 76 are adapted to intermesh with the teeth 64 of the rack section on the slide 36. The pin slot 72 has a general curved shape in this embodiment. The pin slot 72 has an entrance 78 that is aligned with the slot 56 when the member 68 is at a home position on the main housing member 38. The slot 56 has a general straight shape in this embodiment.

The slot 56 and pin slot 72 are adapted to receive the mounting pin 25 (see FIGS. 1 and 2) of the first connector 12 when the first and second connectors are attached to each other. The mounting pin 25 is sized and shaped to slide along the slot 56. The member 68 is adapted to rotate to assist in moving the pin 25 along the length of the slot 56; functioning as a cam and mate assist. More specifically, and referring also to FIGS. 9-12, the user can grasp the slide 36 during connection of the two connectors 12, 14 to each other. When the housing of the first connector 12 is inserted into the second connector 14, the latching by the second latch 62 and second latch receptacle 52 is overcome because the housing 24 moves the second latch 62. The slide 36 can then begin to slide forward on the main housing member 38. Thus, the slide 36 is freed to move when the slide latch 62 is deflected free and disengaged from the latch window 52 by the leading edge of the opposing connector 12 outer housing 24.

Figure 12:
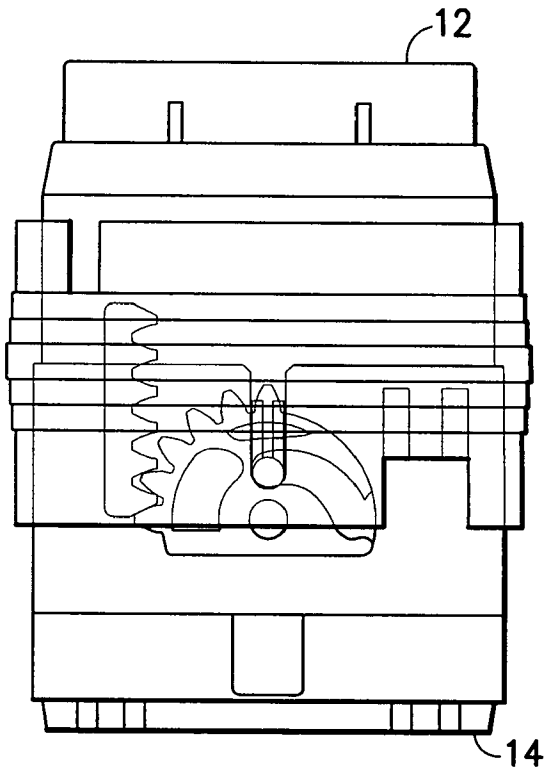
FIG. 12 is a top plan view as in FIG. 11 with the two connectors connected to each other at a final connection position.
Figure 11:
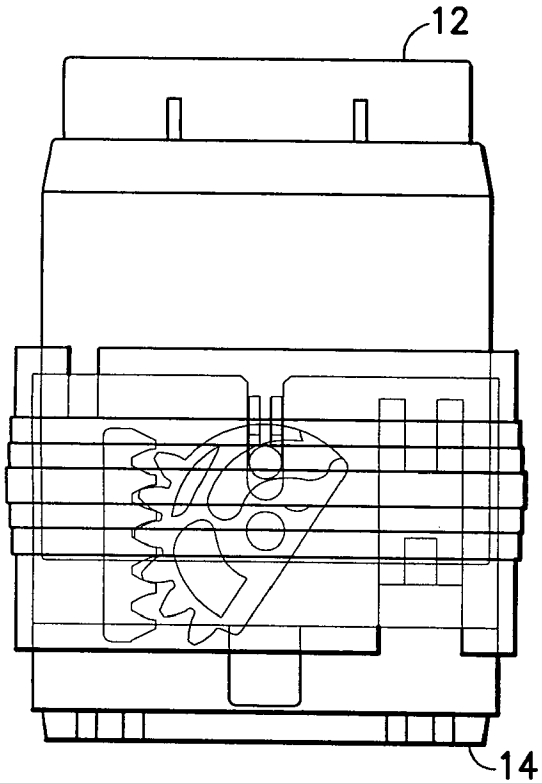
FIG. 11 is a top plan view as in FIG. 10 with the two connectors further connected to each other.

As the slide 36 is moved forward on the main housing member 38, this causes the rack of teeth 64 on the slide 36 to rotate the member 68 because of the intermeshed nature of the teeth 76, 64 as seen in FIG. 11. As the member 68 rotates it cams the pin 25 to move deeper into the length of the slot 56. The pin slot 72 cams against the pin 25 to help move the two connectors 12, 14 into their final connected position with each other as seen in FIG. 12. The first latch 60 engages the first deflectable latch 50 to keep the slide 36 at its forward position on the main housing member 38 and, thus, keep the first and second connectors 12, 14 at their final connected position shown in FIG. 12.

To disconnect the two connectors 12, 14, the latch system 50, 60 is disengaged by the user and the slide 36 is moved to its rearward position. The intermeshing teeth 64, 76 cause the member 68 to rotate while the slide 36 is moved to eject the pin 25, at least partially, from the slot 56. Thus, the invention can also be used to assist in disconnecting the two connectors 12, 14.

Figure 13:
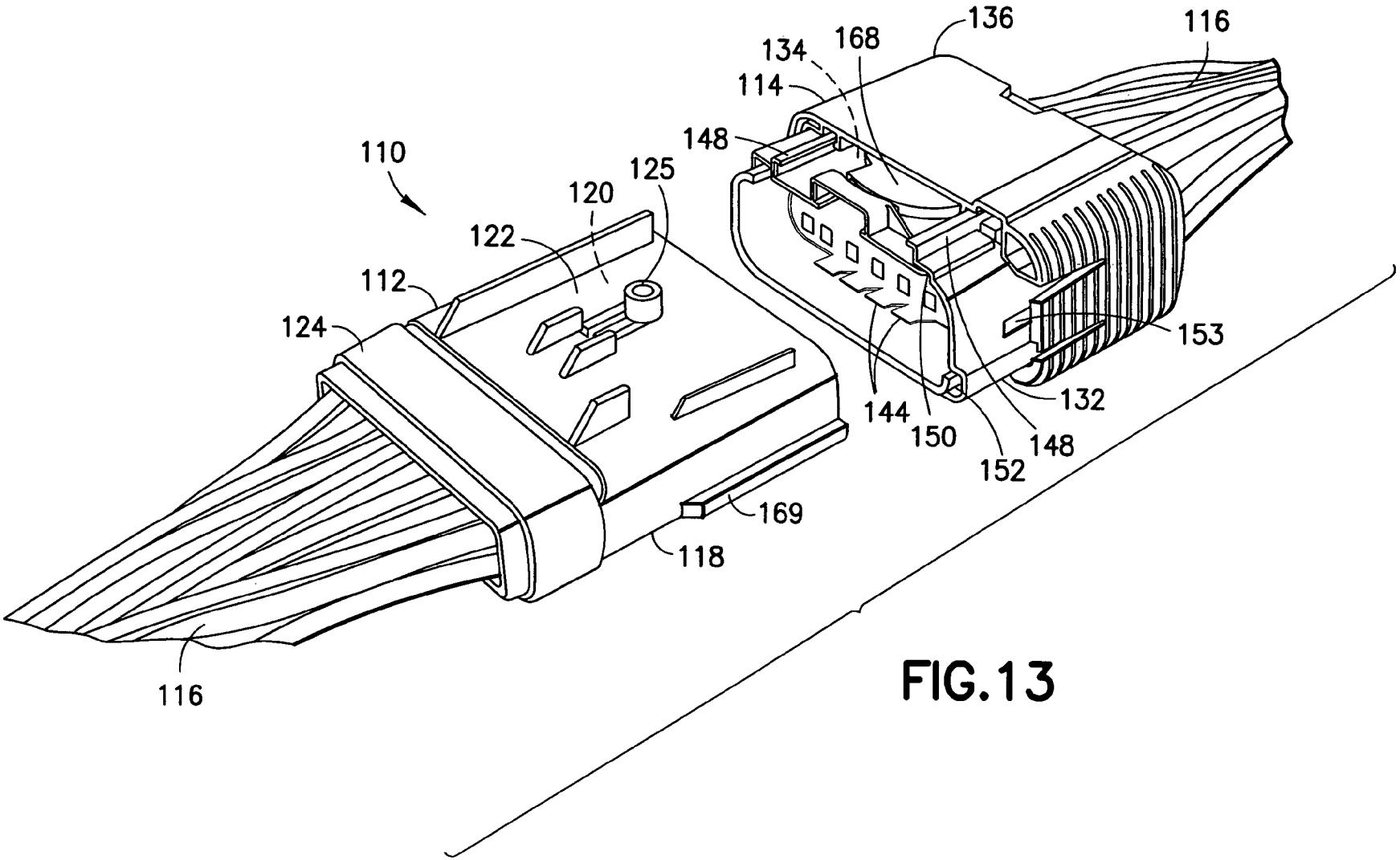
FIG. 13 a perspective view of an electrical connector assembly having a connector comprising features of the invention.

Referring now also to FIGS. 13-36, an alternate embodiment of the invention is shown. FIG. 13 shows a first electrical connector 112, a second electrical connector 114 and electrical conductors 116, such as wires, connected to the electrical connectors 112, 114 which form an assembly 110. The two electrical connectors 112, 114 are adapted to removably mate with each other to electrically connected their respective wires 116 to each other. The first electrical connector 112 generally comprises a housing 118, electrical contacts 120 and a mat wire seal 127 (see FIG. 15). The mat wire seal 127 forms seals and strain relief for the wires 116 entering the rear of the connector 112. The seal 127 is located between the rear end of the outer housing member or retainer 124 and the rear end of the housing member 122. The seal 127 has holes to allow the wires to pass through the seal and which makes a sealing contact with the wires. As seen best in FIG. 15, the first connector 112 also comprises a terminal position assurance (TPA) member 126. The electrical contacts 120 are mounted in contact receiving channels inside the housing member 122. The contacts 120 are crimped or otherwise connected to the wires 116 of the first connector 112. The TPA member 126 is movably mounted on the front end of the housing member 122. The housing 122 has locking latches at the receiving channels for latching the electrical contacts 120 in the receiving channels. After the electrical contacts 120 are inserted into the receiving channels of the inner connector housing 122, the TPA member 126 is pushed rearward on the housing 122 to reinforce the electrical contact locking latches. However, in alternate embodiments any suitable type of housing could be provided and any suitable type of terminal position assurance and primary lock reinforcement could be provided.

The first connector 112 includes electrical shorting bar contacts such as those described in the first embodiment described above. The shorting bar contacts electrically connect pairs of the electrical connectors 120 to each other before the second connector 114 is mated with the first connector 112. However, during mating of the second connector 114 with the first connector 112, the second connector 114 has projections 144 which are adapted to move the contact arms of the shorting bar contacts off of connection with the contacts 120. In an alternate embodiment the shorting bars might not be provided.

Figure 22:
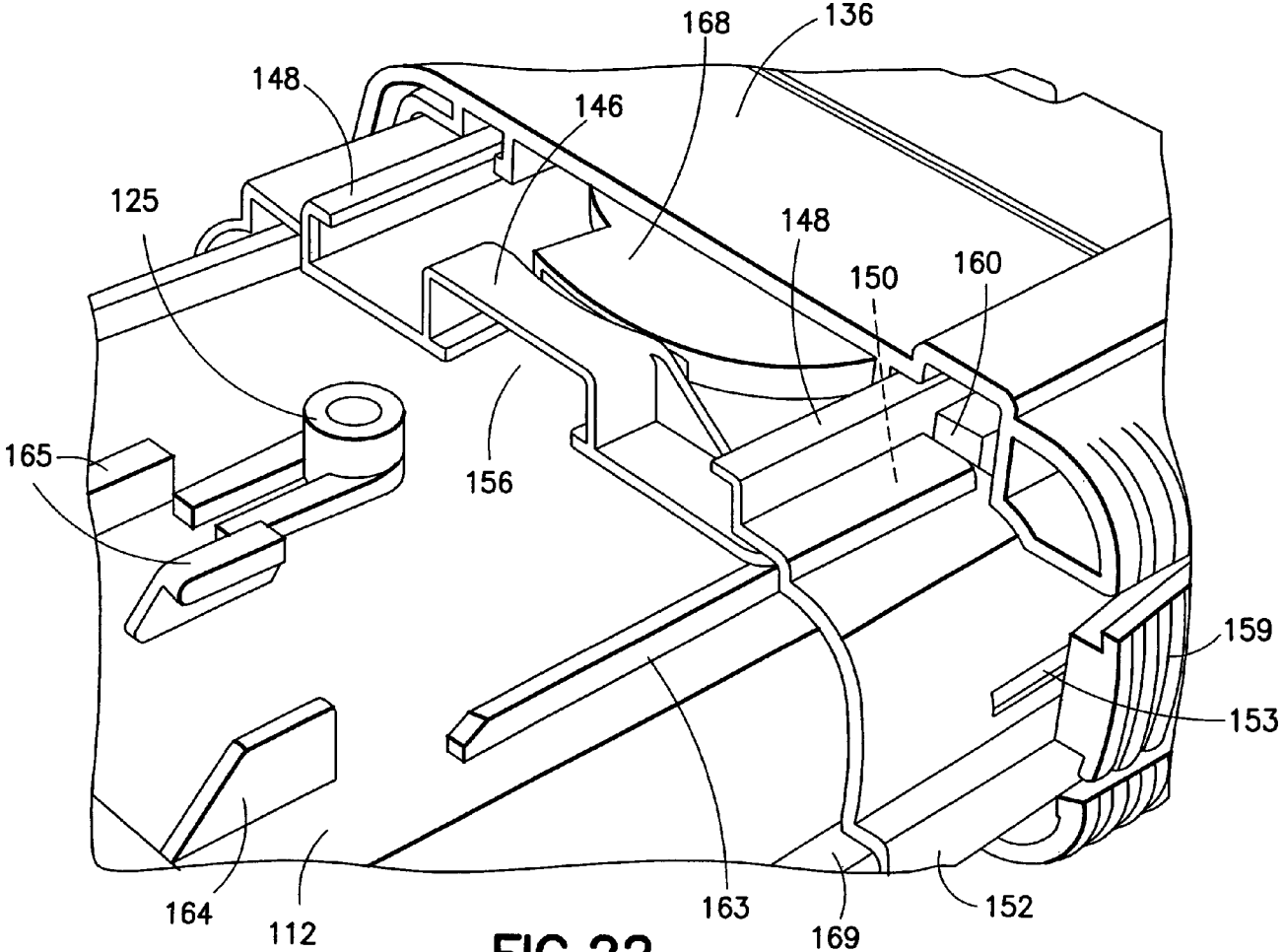
FIG. 22 is an enlarged partial view showing initial connection of the two electrical connectors to each other.

As seen best in FIG. 22, the housing 122 comprises a top side having a cam pin or mounting pin 125, a first rib 163, a stop rib 164, and two sliding interlock features 165. The bottom side of the housing 122 comprises stop ribs 167 (see FIG. 29). A lateral side of the housing 122 has a rib 169.

The second electrical connector 114 generally comprises a housing 132, electrical contacts 134 and a slide 136. As seen best in FIG. 15, the housing 132 generally comprises a main housing member 138, a rear end seal cover or retainer 140 and a front end terminal position assurance (TPA) member 142. The TPA member 142 is mounted to the front end of the main housing member 138, such as with a snap lock connection for example. The TPA member 142 includes forward projecting isolators 144 which are adapted to move the contact arms of the shorting bar contacts off of connection with the contacts 120 when the second electrical connector 114 is connected to the first electrical connector 112. A mat wire seal 130 similar to the seal 127 is located between the rear end of the main housing member 138 and the rear end seal cover 140. A perimeter ring seal 131 is also provided on the second connector 114 to form a seal with the housing of the first connector 112. However, in alternate embodiments, any suitable structure(s) could be provided for the housing component(s) of the second connector 114.

The main housing member 138 comprises contact receiving areas. The electrical contacts 134 are mounted in the receiving areas. The main housing member 138 comprises latches for latching the contacts 134 in the receiving areas. The TPA member 142, when moved to a locked position on the main housing member 138, strengthens the latches to prevent inadvertent withdrawal of the contacts 134 from the main housing member 138. A top side of the main housing member 138 comprises a pivot pin 154 and a slot 156. As seen best in FIG. 22, a shroud 146 is provided over the slot 156. The top side also comprises two sliding interlock features 148 and a rib channel 150. The interlock features 148 comprise two upward extending L shaped legs which point towards each other. A lateral side of the main housing member 138 comprises a rib channel 152 and a latch slot 153.

The rear end seal cover or retainer 140 is mounted to the rear end of the main housing member 138, such as with a snap lock connection for example. The rear seal cover 140 includes wire strain relief tubes. The wires 116 of the second connector 114 extend through the wire strain relief tubes of the rear seal cover 140 and into the contact receiving areas.

With particular reference to FIGS. 16-19, the slide 136 has a general ring or loop shape. In this embodiment, the ring shape is closed and has a general oval shape. However, the ring shape could be open (i.e., not a closed ring shape) and have any suitable shape including rectangular or square for example. The ring shape forms a central channel which receives the main housing member 138.

The slide 136 comprises a top with a first latch 160, a rack of teeth 164, and two sliding interlock features 149 located on the interior facing side of the top. The interlock features 149 comprise two downward extending L shaped legs which point away from each other. In this embodiment, one of the sliding interlock features has the teeth 164 therealong. The top side also comprises a recess 157 into its rear end. The first latch 160 comprises a deflectable cantilevered arm. The arm extends in a forward direction and into the central channel of the slide. The bottom side of the slide 136 has a front end with a recess 158. The left side of the slide 136 has a cantilevered portion 159 at its front end with a second latch 162 extending inward from the cantilevered portion. The second latch 162 comprises a deflectable cantilevered arm. The arm extends in a rearward direction and into the central channel of the slide. The two latches 160, 162 are offset about 90 degrees relative to each other. Thus, the two latches 160, 162 extend into the central channel of the slide in different directions. However, in alternate embodiments, any suitable type of latches could be provided.

The slide 136 is sized and shaped to be mounted over and substantially surround the main housing member 138. The slide 136 can slide along the main housing member between a rear position and a forward position. When the slide is moved to the forward position by a user, the second latch 162 is adapted to latch into the latch slot 153 to retain the slide 136 at the forward position on the main housing member 138. Thus, the second latch 162 and the latch slot 153 form a first latch system. The first latch 160 is adapted to engage the rear end of the rib channel 150 to retain the slide 136 at the retracted rear position on the main housing member 138 until the second connector 114 is at least partially mated with the first connector 112 as further described below. Thus, the first latch 160 and the rear end of the rib channel 150 form a second latch system.

Figure 14:
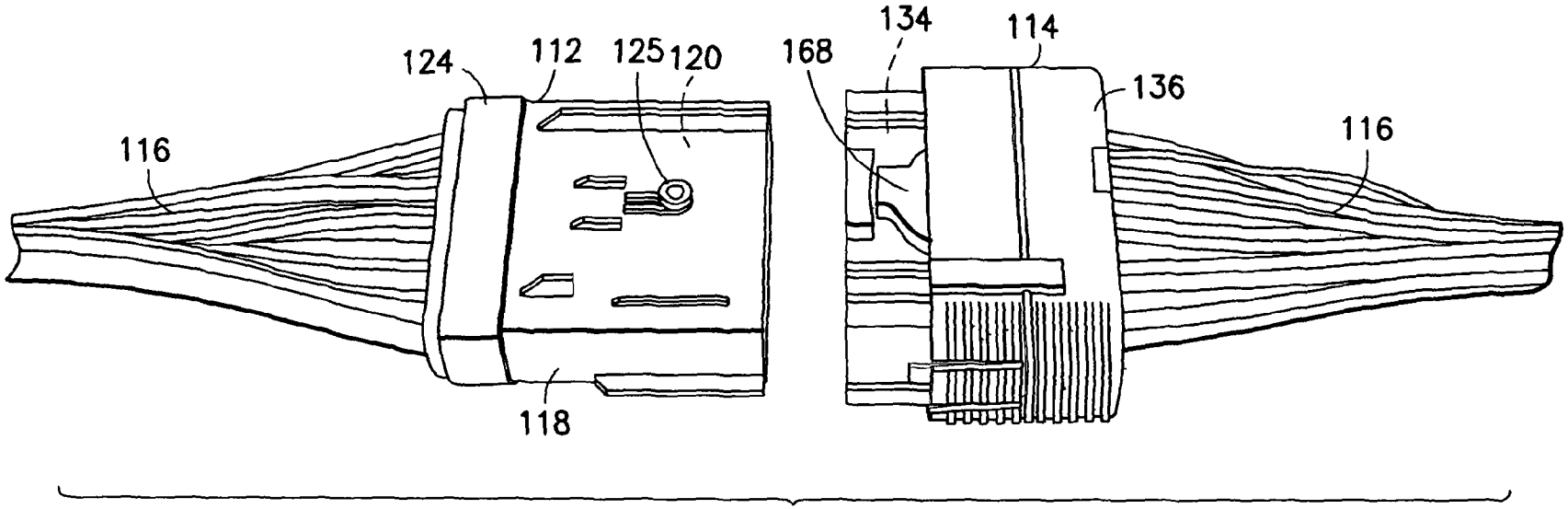
FIG. 14 is a perspective view of the connectors shown in FIG. 13 from another angle.
Figure 15:
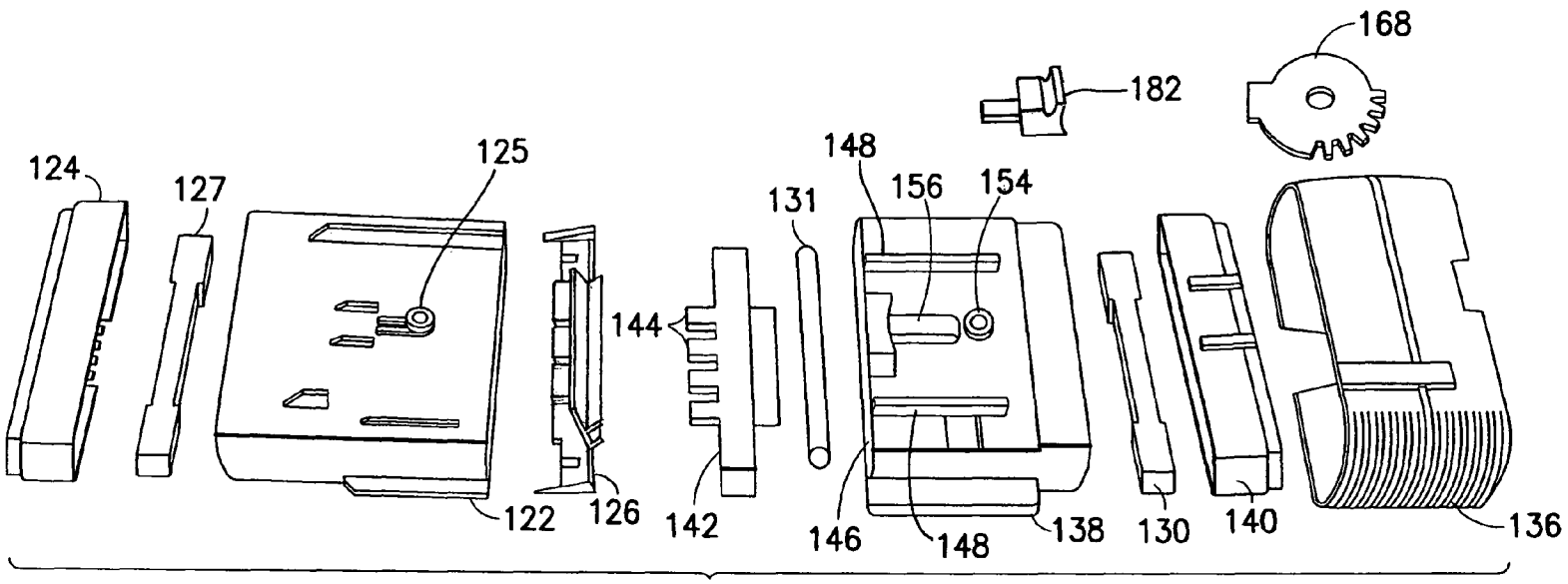
FIG. 15 is an exploded perspective view of components of the electrical connectors shown in FIGS. 13 and 14.
Figure 16:
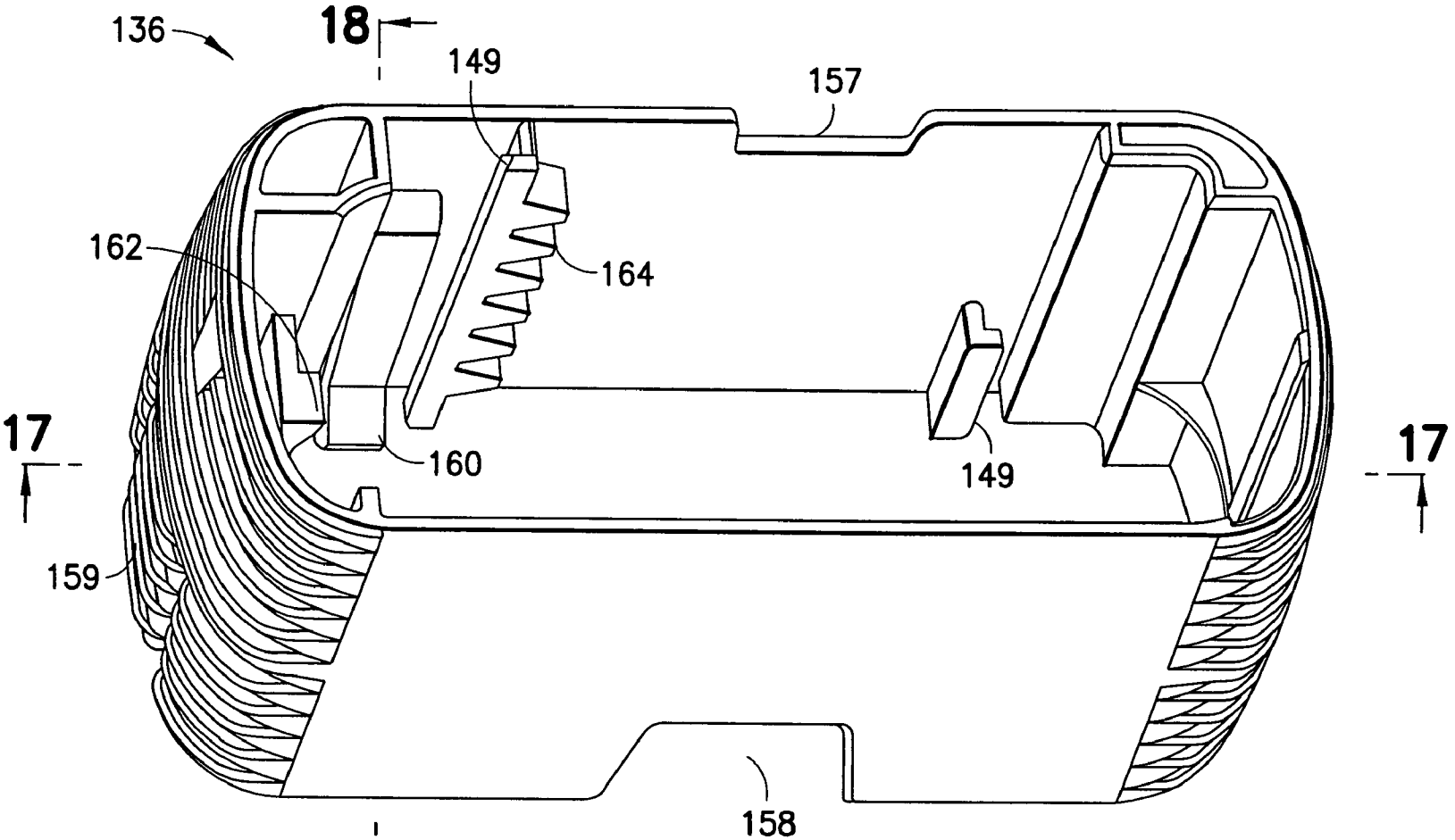
FIG. 16 is a bottom rear perspective view of the slide of the second electrical connector shown in FIG. 13.
Figure 17:
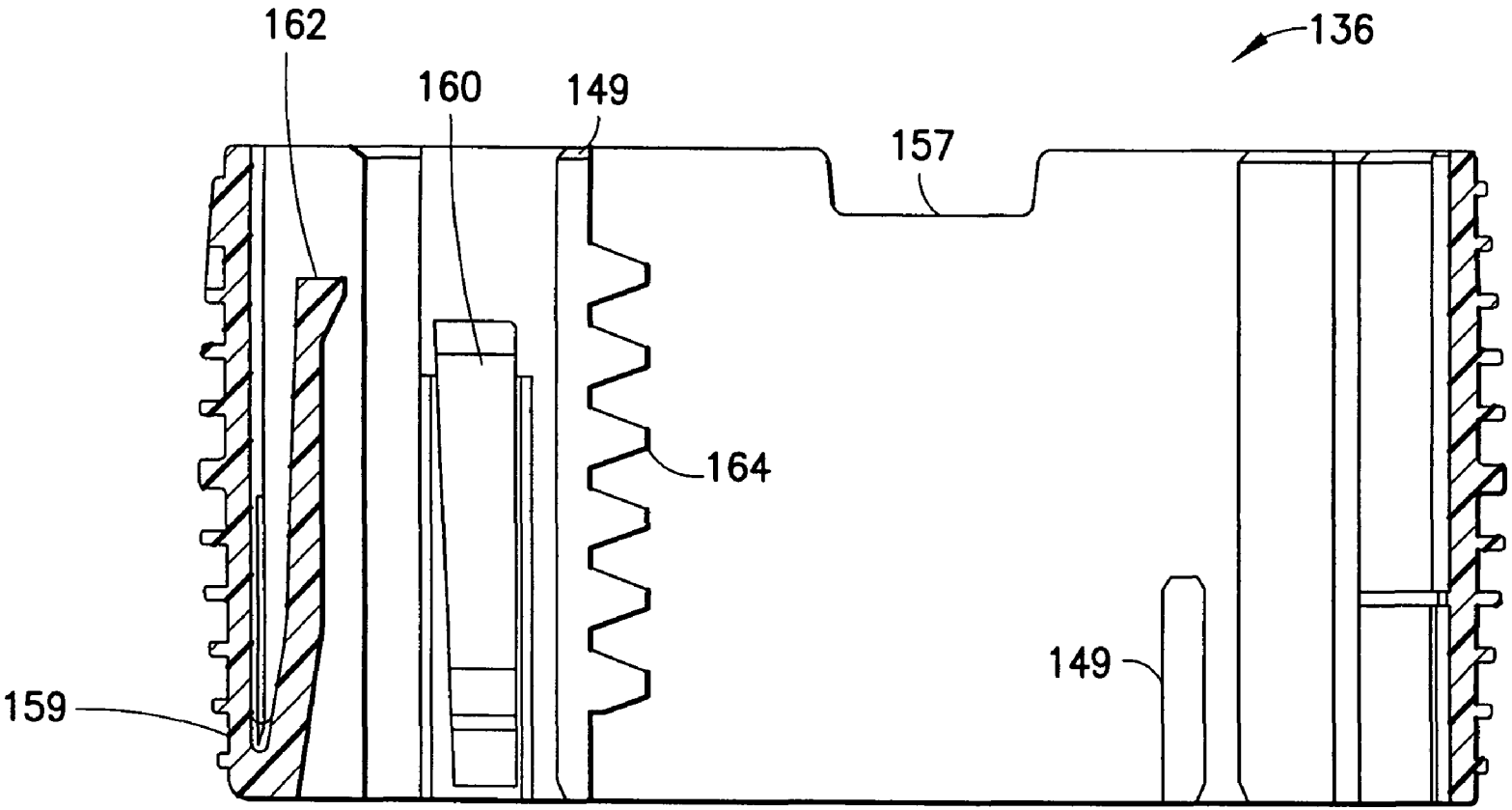
FIG. 17 is a cross sectional view of the slide shown in FIG. 16 taken along line 17-17.
Figure 19:
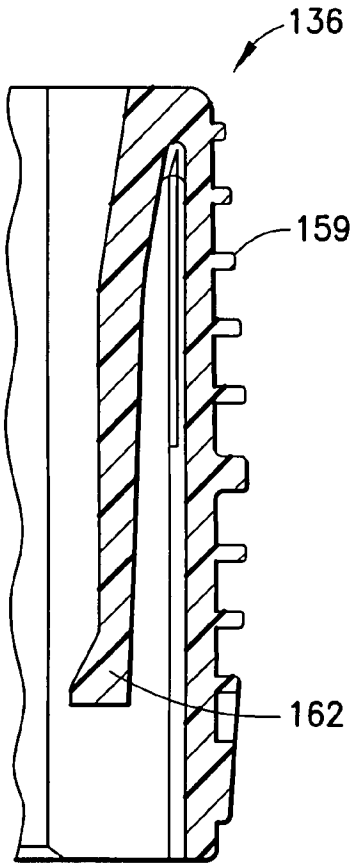
FIG. 19 is a partial cross sectional view of the second latch of the slide shown in FIG. 16.
Figure 18:
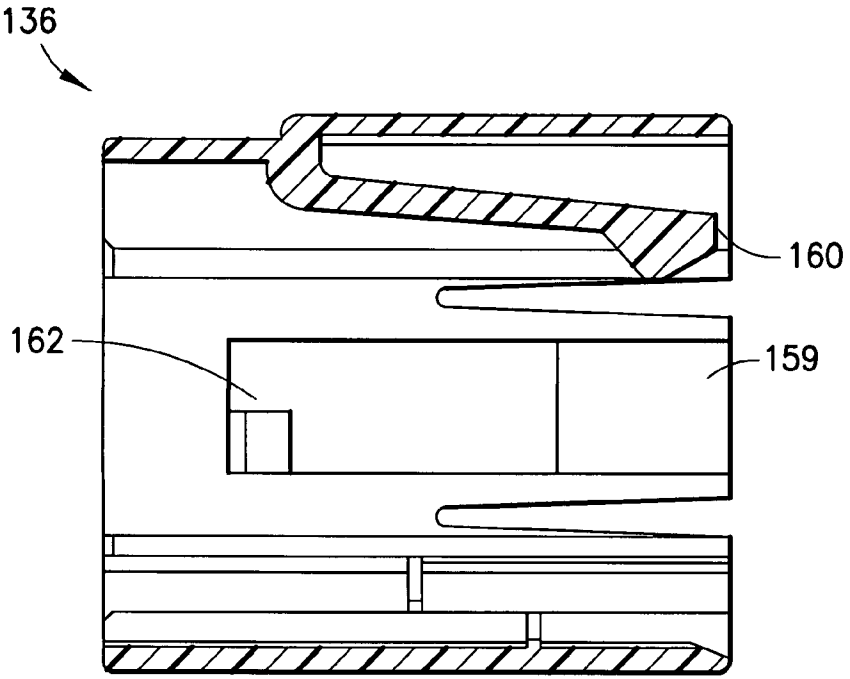
FIG. 18 is a cross sectional view of the slide shown in FIG. 16 taken along line 18-18.

Referring particularly to FIGS. 13, 15, 20 and 21 the second connector 114 also comprises a combined pinion gear and cam member 168. FIGS. 13 and 14 show the slide 136 at its rear home position. These figures also shows the member 168 at its corresponding home position. The member 168 comprises a pivot hole 170, a pin slot 172, a gear section 174 with teeth 176, and a CPA slot 166. The member 168 is rotatably mounted on the main housing member 138 with the pivot pin 154 located in the pivot hole 170. The teeth 176 are adapted to intermesh with the teeth 164 of the rack section on the slide 136. The pin slot 172 in this embodiment has a front straight section, a middle general curved shape, and a rear section. The pin slot 172 has an elongated front straight entrance 178 that is aligned with the slot 156 when the member 168 is at a home position on the main housing member 138. The elongated front straight shape of the entrance 178 has been provided as an extended lead-in to greatly increase the timing window in which the pin 125 is inserted into the slot 156 before unlocking the pre-lock finger/latch 160 and the slide 136 begins to move the member 168. The slot 156 has a general straight shape in this embodiment.

The slot 156 and pin slot 172 are adapted to receive the mounting pin 125 (see FIGS. 13-15, 20A and 22) of the first connector 112 when the first and second connectors are attached to each other. The mounting pin 125 is sized and shaped to slide along the slot 156. The member 168 is adapted to rotate to assist in moving the pin 125 along the length of the slot 156; functioning as a cam and mate assist.

Figure 23:
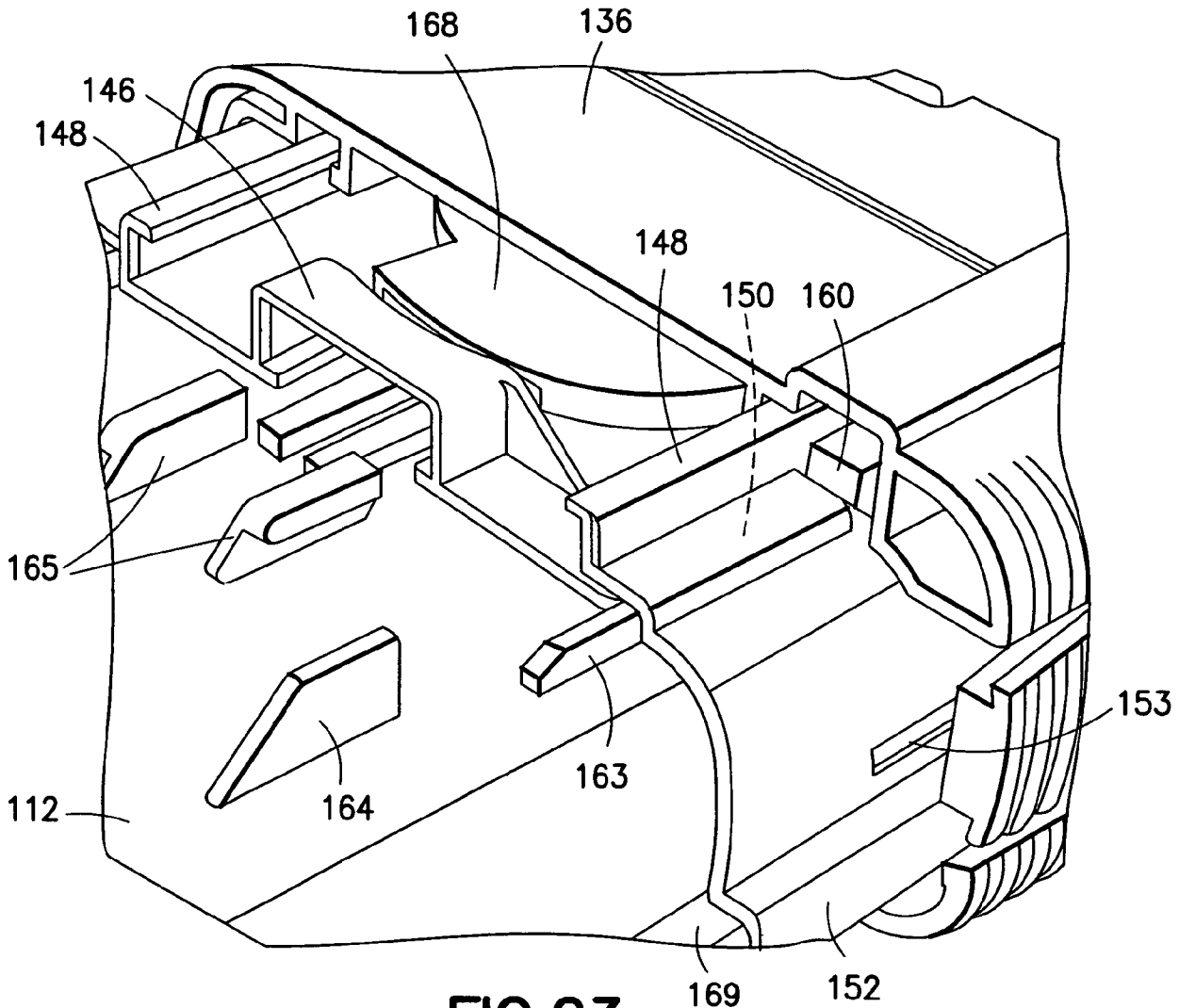
FIG. 23 is an enlarged partial view as in FIG. 22 showing a subsequent partial connected position.
Figure 24:
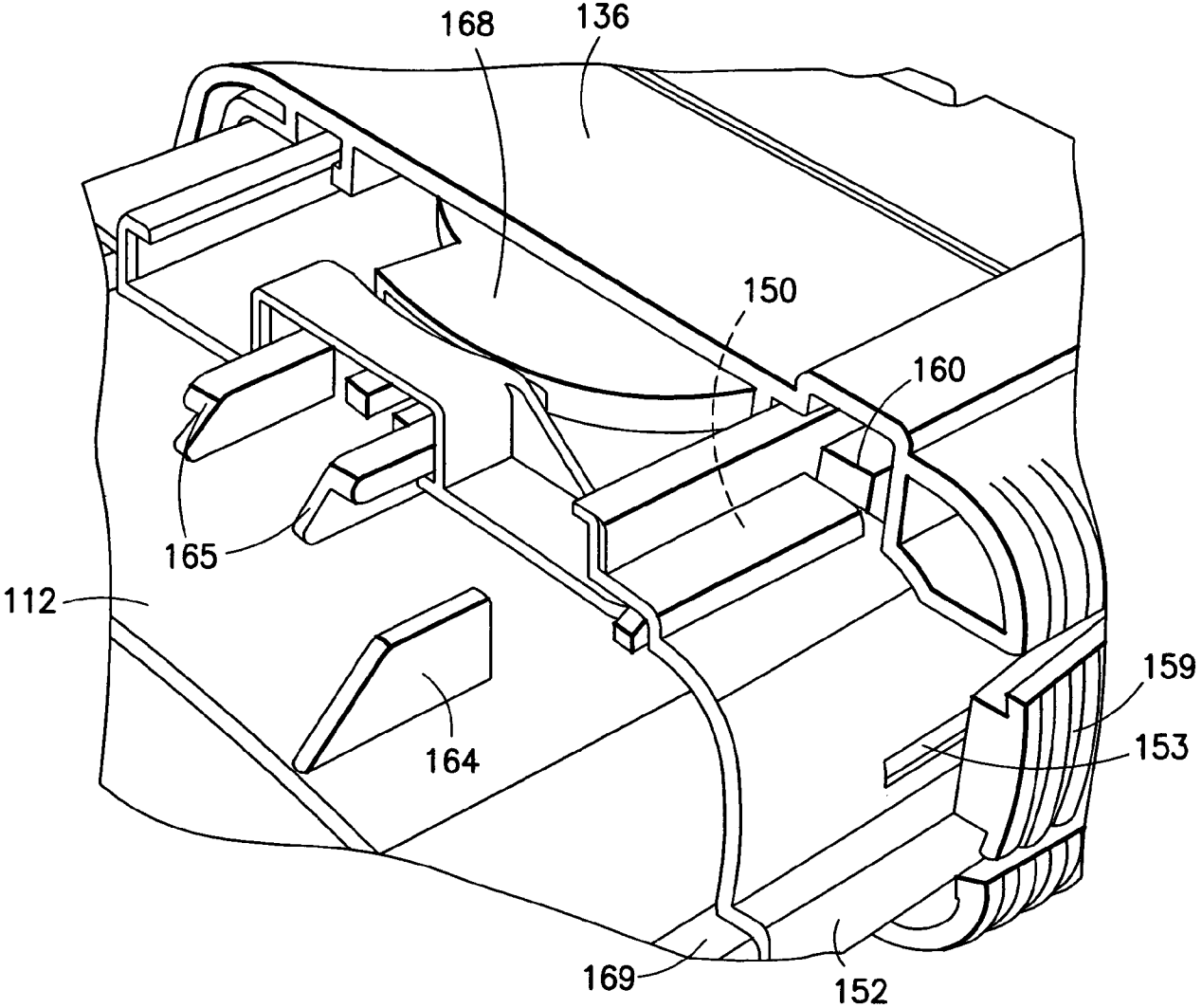
FIG. 24 is an enlarged partial view as in FIG. 23 showing a subsequent partial connected position.

The user would normally grasp the second connector 114 on the exterior of the slide 136 to mate the two connectors 112, 114 together. As seen in comparing FIG. 22 to FIG. 23 and also referring to FIGS. 20 and 20A, when the two connectors 112, 114 are initially connected with each other, the mounting pin 125 passes partially into the slot 156 under the shroud 146. The mounting pin 125 enters the entrance 178 of the member 168. The slide 136 is unable to move relative to the main housing member 138 because of the engagement of the first latch 160 with the rear end of the rib channel 150. The rib 163 of the mating connector slides into the rib channel 150 as seen in FIG. 23. Eventually, the front end of the rib 163 contacts the first latch 160 and wedges the front end of the first latch 160 from its latched engagement with the rear end of the rib channel 150. Thus, when the housing of the first connector 112 is inserted into the second connector 114, the latching by the first latch 160 and the rear end of the rib channel 150 is overcome because the rib 163 of the housing 124 moves the first latch 160. With this disengagement, the slide 136 is now able to slide forward relative to the main housing member 138. Thus, the slide 136 is freed to move when the slide latch 160 is deflected free and disengaged from the rear end of the rib channel 150 by the leading edge of the rib 163.

Figure 20A:
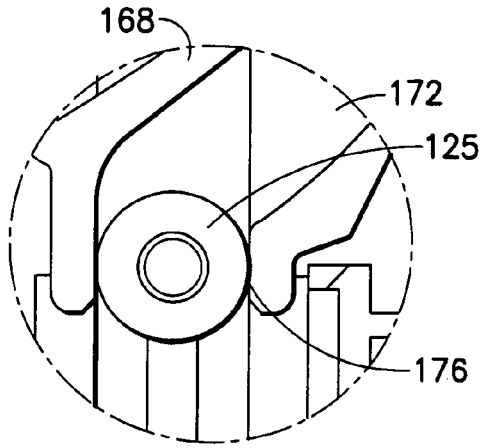
FIG. 20A is an enlarged view of a portion of the connectors shown in FIG. 20.
Figure 20:
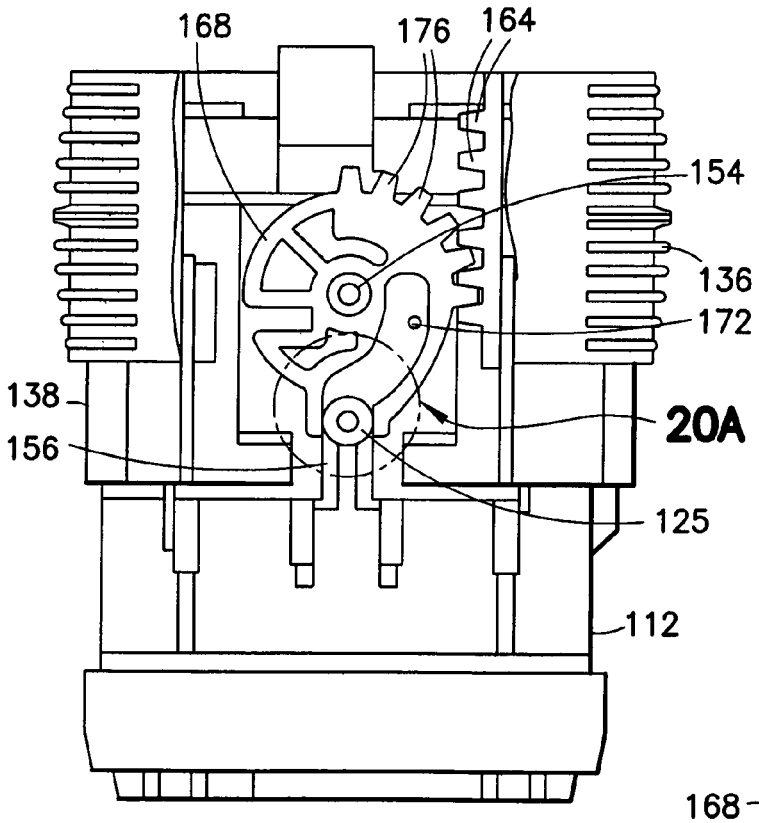
FIG. 20 is a top view with a cut away section showing initial connection of the two electrical connectors of FIG. 13 to each other.
Figure 21:
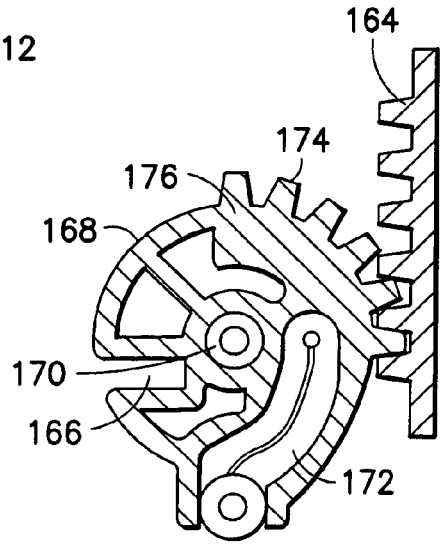
FIG. 21 is an illustration showing the intermeshing teeth of the combined cam and gear member and the rack gear section of the slider.
Figure 25:
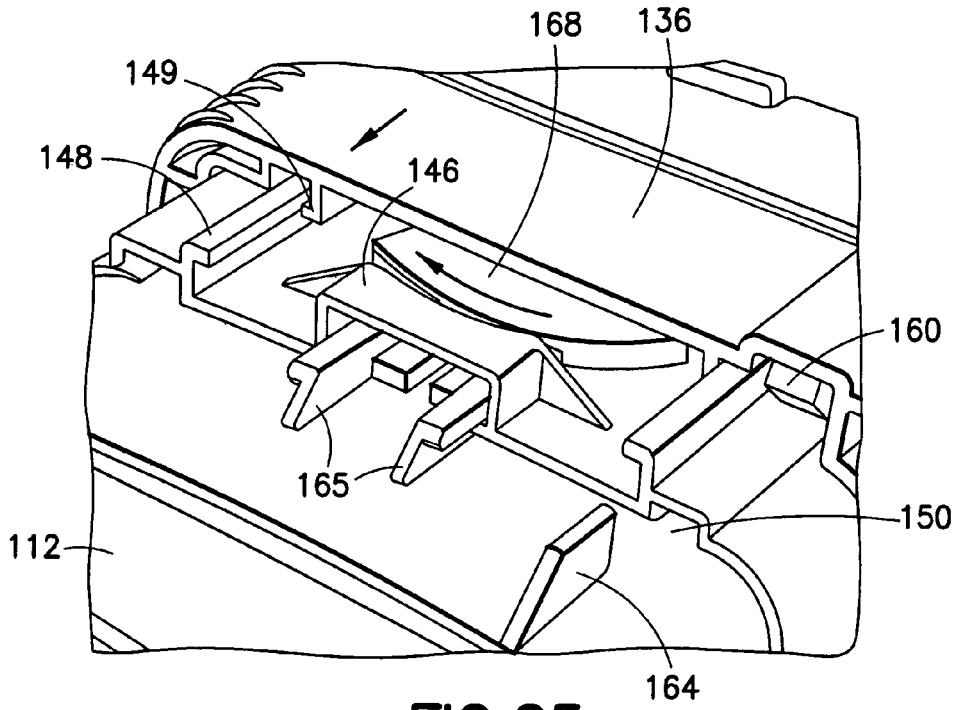
FIG. 25 is an enlarged partial view as in FIG. 24 showing a subsequent partial connected position.
Figure 28:
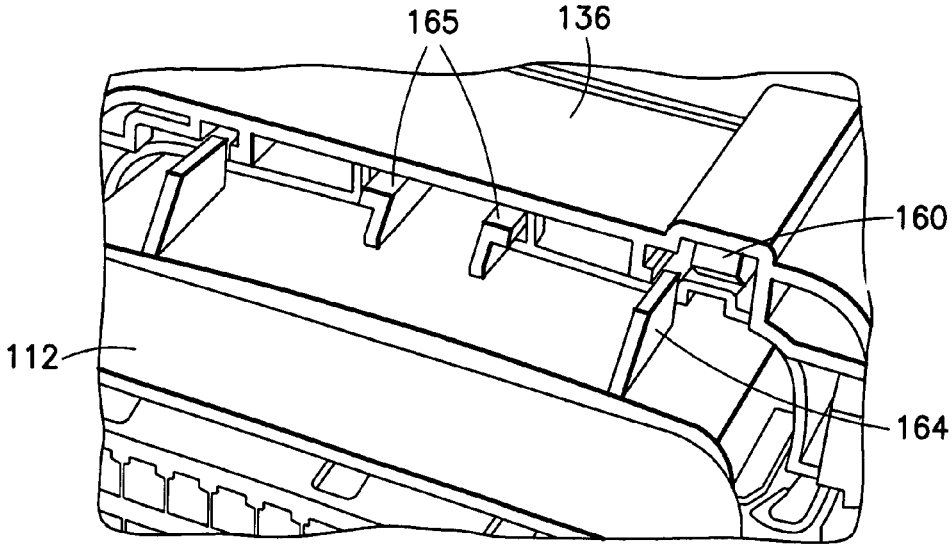
FIG. 28 is an enlarged partial view showing final connection of the two electrical connectors to each other.
Figure 26:
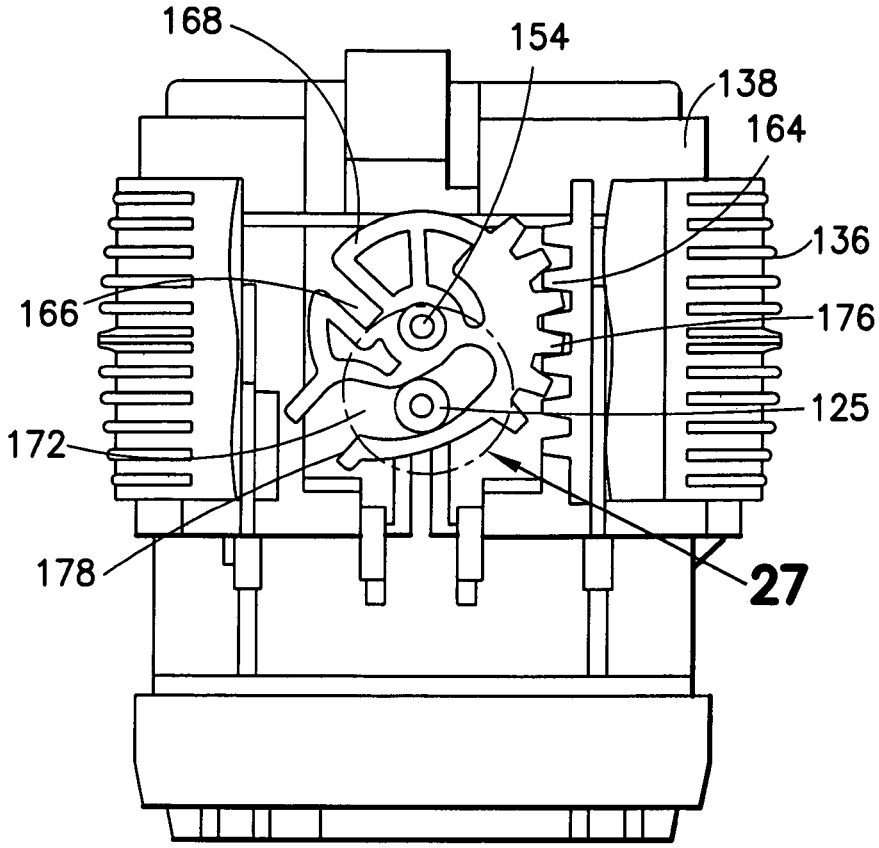
FIG. 26 is a top view with a cut away section showing the two electrical connectors in the position shown in FIG. 25.

As seen with reference to FIGS. 24-27, as the slide 136 further moves forward on the main housing member 138, the member 168 axially rotates on the pin 154. As the slide 136 is moved forward on the main housing member 138, this causes the rack of teeth 164 on the slide 136 to rotate the member 168 because of the intermeshed nature of the teeth 176, 164 as seen in FIGS. 20 and 21. As the member 168 rotates, it cams the pin 125 to move deeper into the length of the slot 156. The pin slot 172 cams against the pin 125 to help move the two connectors 112, 114 into their final connected position with each other as seen in FIG. 28. Thus, the first connector 112 is cammed into the second connector 114. As seen in FIG. 25, the sliding interlock features 165 engage the sliding interlock surfaces of the main housing member 138 under the shroud 146 to limit relative deflection during mating. The sliding interlock features 148, 149 of the main housing member 138 and the slide 136 are always engaged to also limit relative deflection during mating and provide positional constraint of the cam-gear 168.

Figure 27:
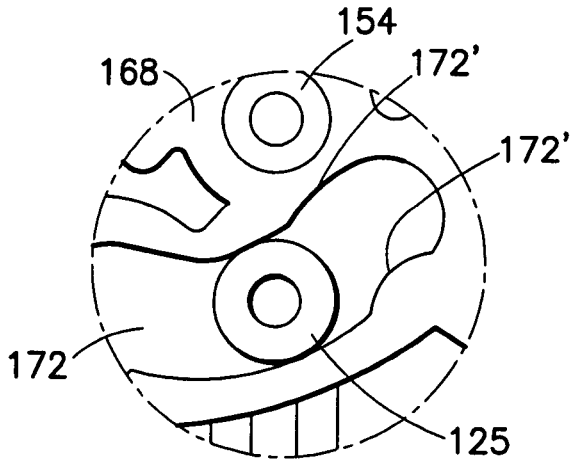
FIG. 27 is an enlarged section of the two connectors shown in FIG. 26.
Figure 29:
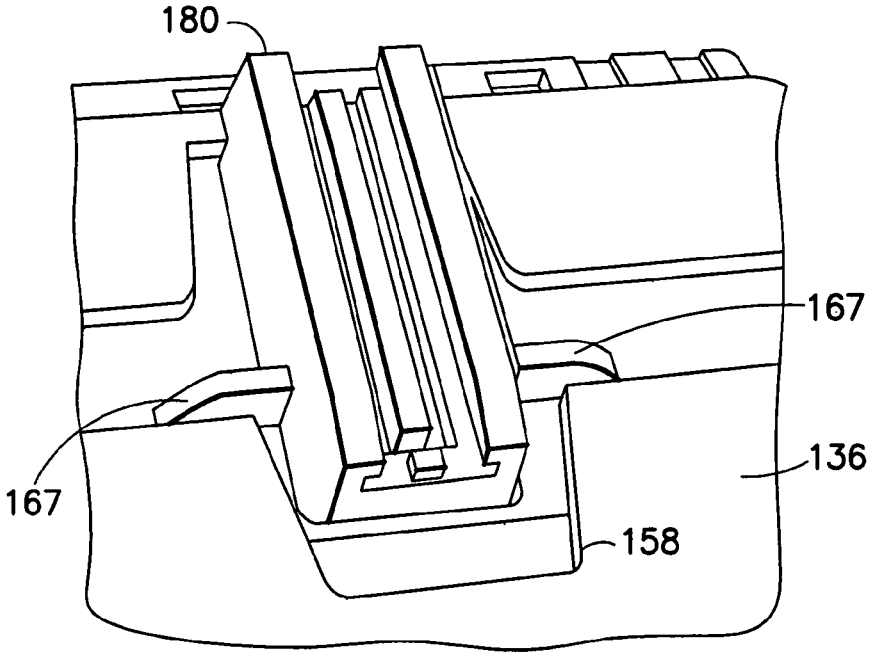
FIG. 29 is a perspective view of bottom portions of the slide and the first connector in the final connection position shown in FIG. 28.
Figure 30:
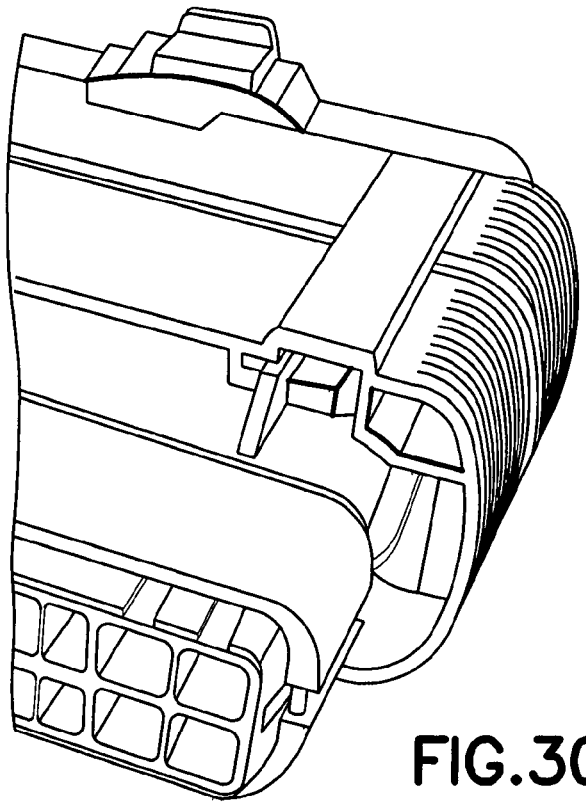
FIG. 30 is a perspective view of side portions of the slide and the first connector in the final connection position shown in FIG. 28.
Figure 32:
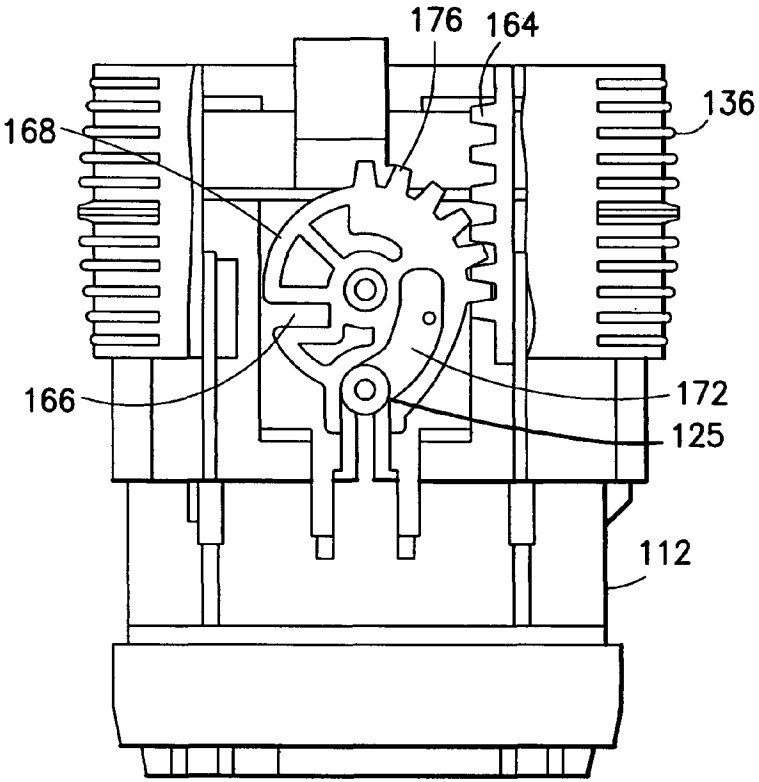
FIGS. 31-34 are top views with a cut away section showing a sequence of the two electrical connectors of FIG. 13 in various relative positions of connection.
Figure 31:
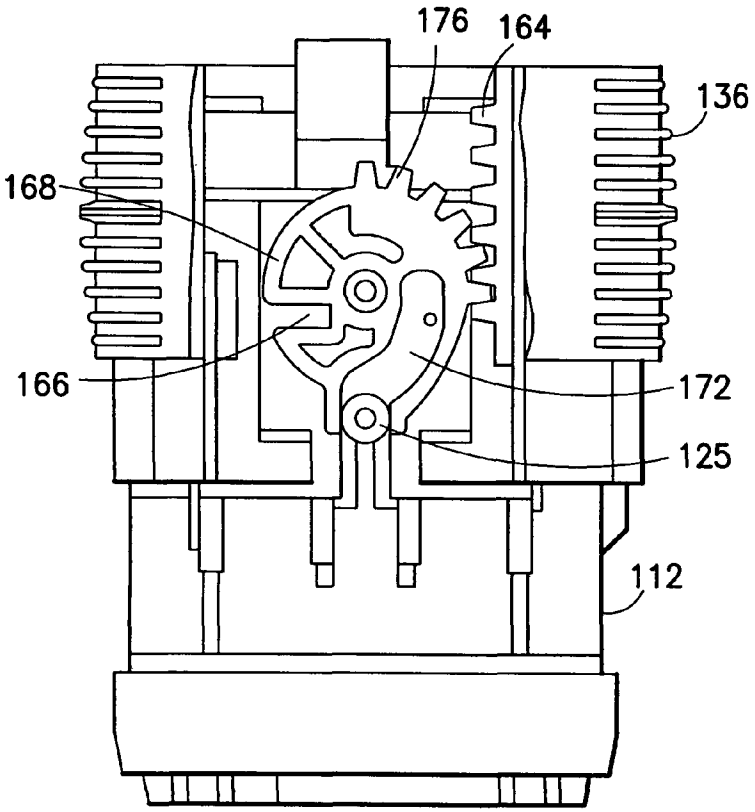
Figure 34:
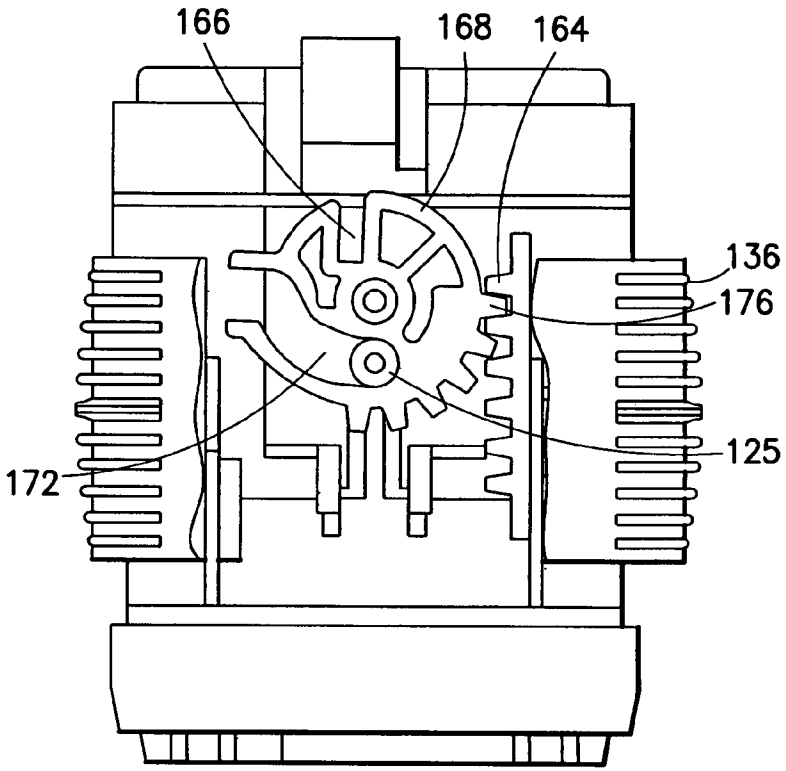
Figure 33:
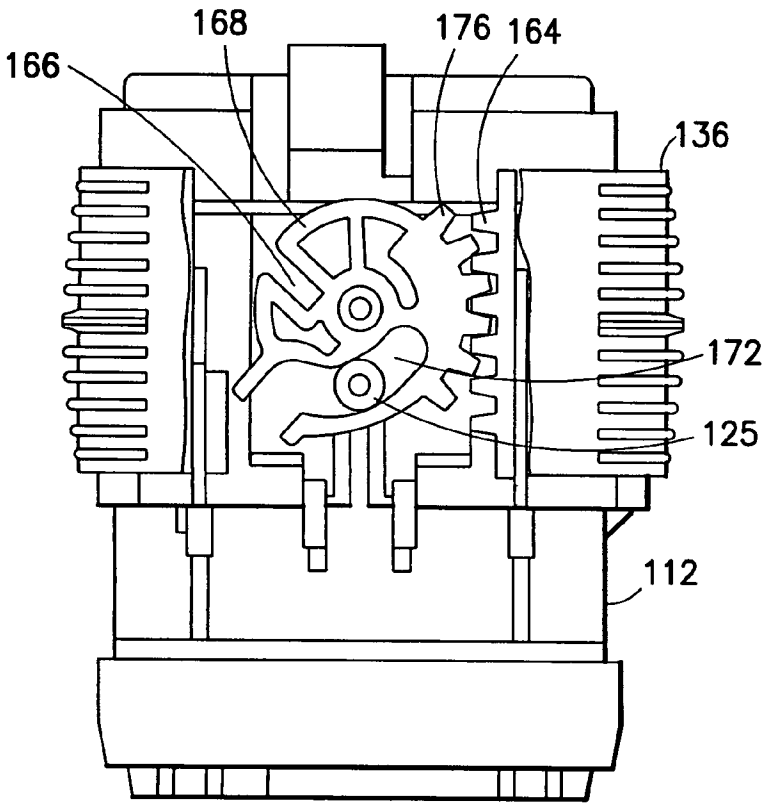

FIG. 28 shows the final positions of the housing members 122, 138 and the slide 136. Because the slot 172 has a serpentine shaped rear end with shaped surfaces (projection and recess) 172' as shown in FIG. 27, there is a noticeable tactile change sensed by the user when the slide 136 and the member 168 comes to their final position. This tactile sensation helps the user know that the final connected position has been reached. The stop rib 164 is able to stop the forward motion of the main housing member 138 and the slide 136 on the housing member 122 of the first connector 112. As shown in FIG. 29, the stop ribs 167 on the bottom of the housing member 122 are also able to stop the forward movement of the slide 136. FIG. 29 also shows that the recess 158 can accommodate a portion 180 of the housing member 122 therein, such as a mounting latch for stationarily mounting the housing member to another member. In the final connected position the front end of the second latch 162 is able to latch into the slot 153 to thereby lock the position of the slide 136 on the main housing member 138. The second latch 162 engages the latch slot 153 to keep the slide 136 at its forward position on the main housing member 138 and, thus, keep the first and second connectors 112, 114 at their final connected position shown in FIG. 28. Various positions of the components of the assembly 110 during mating are shown in FIGS. 31-34.

Figure 35:
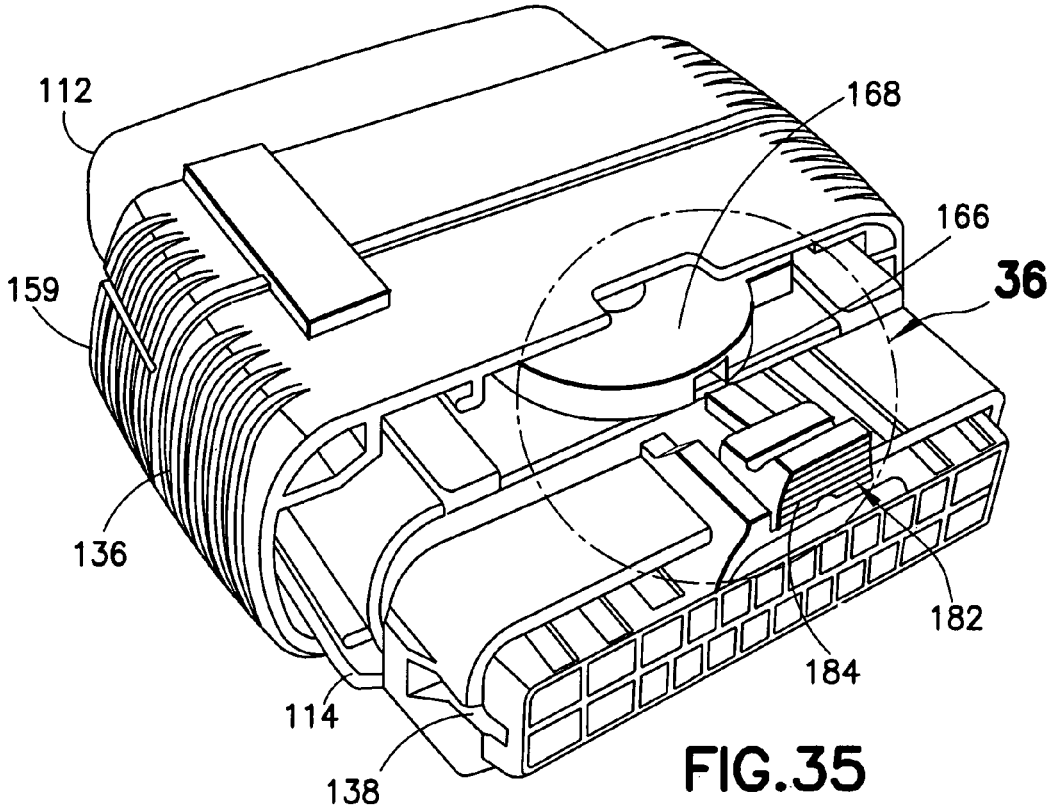
FIG. 35 is a perspective view of the connectors as shown in FIG. 28 from a rear end of the second connector.
Figure 36:
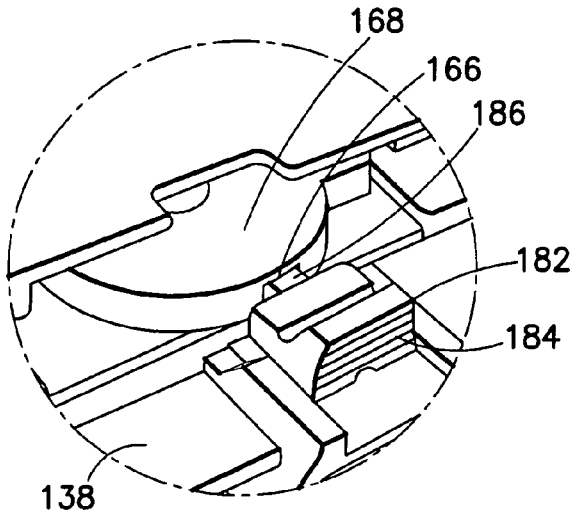
FIG. 36 is an enlarged view of a portion of the connector assembly shown in FIG. 35 with the CPA member moved to a locked position.

Referring also to FIGS. 35-36, the second connector 114 in this embodiment comprises a connector position assurance (CPA) member 182. The CPA member 182 has a finger contact area 184 and a locking projection 186. The finger contact area 184 is located at a rear of the CPA member and the locking projection 186 is located at a front end of the CPA member. The CPA member is slidably located on the top side of the retainer 140, but could be located on the top side of the main housing member 138. FIG. 35 shows the CPA member 182 in a rear unlocked position. FIG. 36 shows the CPA member 182 in a forward locked position. In the unlocked position, the locking projection 186 is spaced from the member 168. As noted above, the member 168 has a CPA slot 166 (see FIG. 21). The CPA slot 166 is offset about 90 degree relative to the entrance 178 to the slot 172. However, in an alternate embodiment the pinion gear and cam member could be adapted to rotate more or less than 90 degrees. Thus, the CPA slot could be offset more or less than 90 degrees, such as 180 degrees for example. When the member 168 is located in its connected position as shown in FIG. 35, the CPA slot 166 is located facing rearward; aligned with the locking projection 186. Thus, the user can slide the CPA member 182 forward to insert the locking projection 168 into the CPA slot 166 as shown in FIG. 36. With the locking projection 168 located in the CPA slot 166, the member 168 is locked in its connected position and is unable to axially rotate. This locks the two connectors 112, 114 together because the pin 125 cannot be disengaged. In an alternate embodiment, the CPA member might not be provided. Alternatively, any suitable CPA member could be provided.

To disconnect the two connectors 112, 114, the CPA member 182 (if provided) is disengaged by moving it rearward. The latch system 162, 153 is disengaged by the user pressing the front end of the cantilevered portion 159 inward. This causes the arm of the latch 162 to pivot on a portion of the main housing member 138 and move its distal end out of the hole 153. The user is then able to move the slide 136 to its rearward position. The intermeshing teeth 164, 176 cause the member 168 to rotate while the slide 136 is moved to eject the pin 125, at least partially, from the slot 156. Thus, the invention can also be used to assist in disconnecting the two connectors 112, 114.

Figure 37:
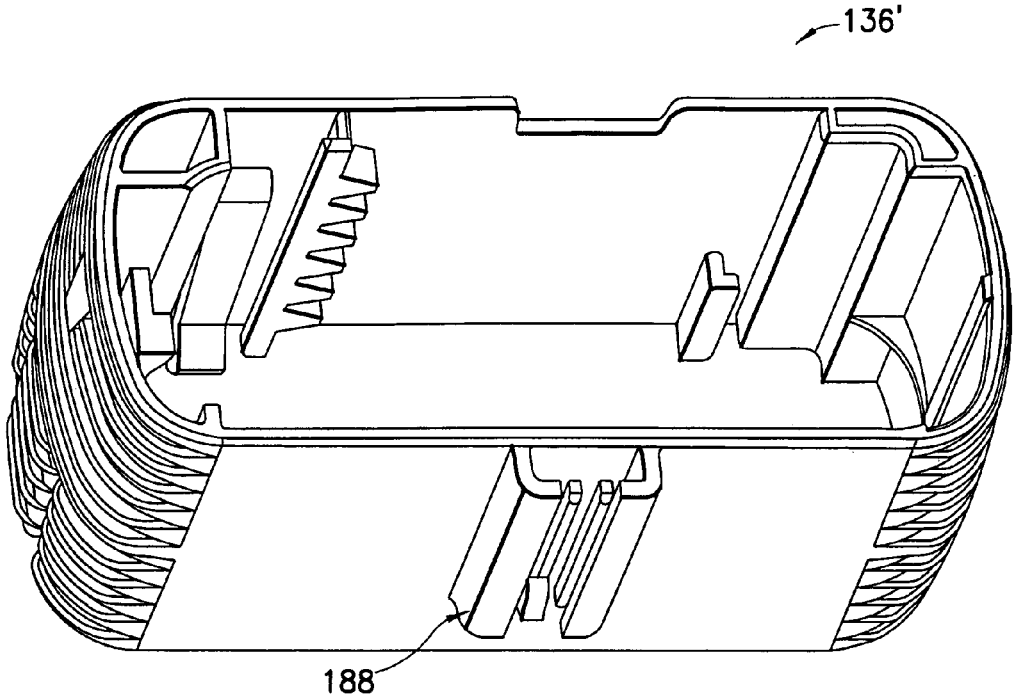
FIG. 37 is a perspective view of an alternate embodiment of the slide shown in FIG. 16.
Figure 38:
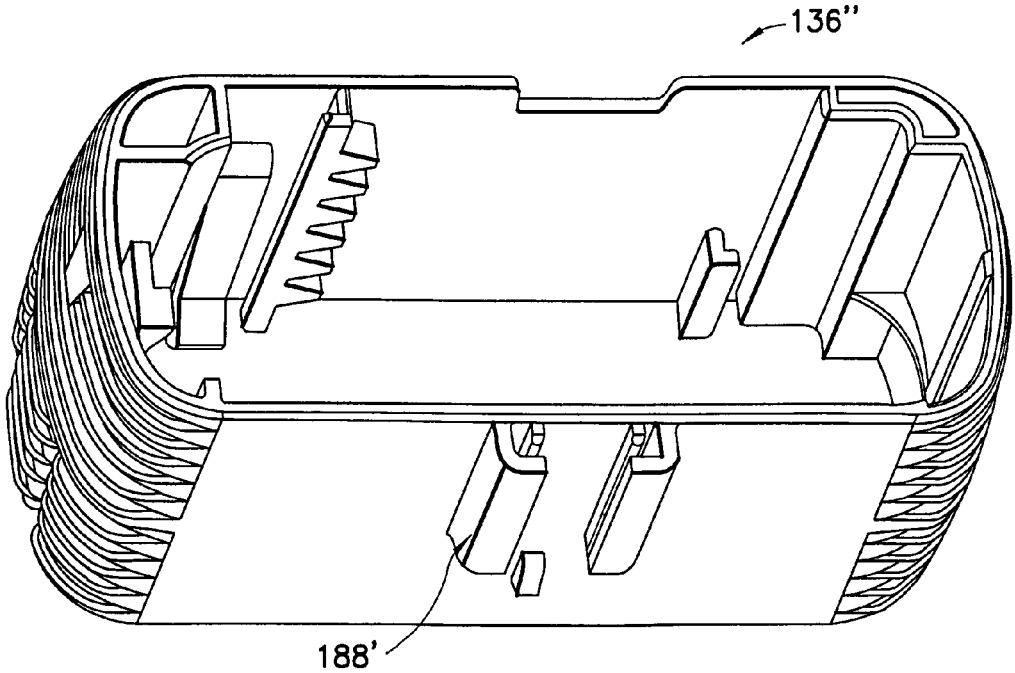
FIG. 38 is a perspective view of another alternate embodiment of the slide shown in FIG. 16.

Referring also to FIGS. 37 and 38, alternative embodiment of the slide 136 are shown. In these embodiments, the slides 136' and 136" are identical to the slide 136 except that they do not have the recess 158 and except that they each comprise a latch 188, 188'. The latches 188, 188' allow the slides 136', 136" to be stationarily mounted on another member (similar to latch 180 shown in FIG. 30). Thus, the first connector 112 (less its latch 180) can be plugged into the second connector having the latch 188 or 188' with the slide 136' or 136" stationary. The first connector 112 and the main housing second 138 of the second connector can move relative to each other and the slide 136' or 136".

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

a housing;

a slide slidably mounted to the housing, wherein the slide comprises a rack section with teeth, and wherein the slide is adapted to slide over a portion of a mating electrical connector when the electrical connector is connected to the mating electrical connector;

a cam member rotatably mounted to the housing, wherein the cam member comprises a caming surface adapted to contact a cam portion of the mating electrical connector, and wherein the cam member comprises a gear section with teeth engaging the teeth of the slide; and a connector position assurance (CPA) member movably connected to the housing, wherein the CPA member is adapted to directly engage the cam member for preventing the cam member from rotating relative to the housing.

2. An electrical connector as in claim 1 wherein the cam member comprises a CPA slot adapted to receive a portion of the CPA member.

3. An electrical connector as in claim 2 wherein the cam member comprises a cam slot forming the caming surface, and wherein an entrance to the CPA slot is offset about 90 degrees from an entrance to the cam slot.

4. An electrical connector as in claim 1 wherein the slide comprises a main housing section having a general ring shape with a central channel with the housing slidably located therein.

5. An electrical connector as in claim 4 wherein the slide comprises:

a first latch comprising a first deflectable cantilevered arm extending into the central channel in a first direction; and a second latch comprising a second deflectable cantilevered arm extending into the central channel in a second direction.

6. An electrical connector as in claim 5 wherein the cam member comprises a CPA slot adapted to receive a portion of the CPA member.

7. An electrical connector as in claim 6 wherein the cam member comprises a cam slot forming the caming surface, and wherein an entrance to the CPA slot is offset about 90 degrees from an entrance to the cam slot.

8. An electrical connector as in claim 7 wherein the CPA member is slidably mounted directly on the housing proximate a rear side of the cam member.

9. An electrical connector as in claim 8 further comprising electrical contacts mounted to the housing.

10. An electrical connector as in claim 9 wherein the cam member comprises a pin receiving slot, and wherein the pin receiving slot comprises an elongated straight entrance.

11. An electrical connector comprising:

a housing;

a slide slidably mounted to the housing, wherein the slide comprises a rack section with teeth;

a cam member rotatably mounted to the housing, wherein the cam member comprises a taming surface adapted to contact a cam portion of a mating electrical connector, and wherein the cam member comprises a gear section with teeth engaging the teeth of the slide; and a connector position assurance (CPA) member movably connected to the housing, wherein the CPA member is adapted to directly engage the cam member for preventing the cam member from rotating relative to the housing, wherein the CPA member is slidably mounted directly on the housing proximate a rear side of the cam member.

12. An electrical connector slide member comprising:

a main housing section having a general ring shape with a central channel adapted to receive a housing of an electrical connector therein;

a rack section comprising teeth on the main section at the central channel arranged in a row as a series along a longitudinal length of the rack section;

a first latch comprising a first deflectable cantilevered arm extending into the central channel in a first direction; wherein the first arm extends from a front end of a cantilevered section of a side wall of the main housing section and a second latch comprising a second deflectable cantilevered arm extending into the central channel in a second direction, wherein the second arm extends from a top wall or a bottom wall of the main housing generally perpendicular to the side wall.

13. An electrical connector slide member as in claim 12 wherein the general ring shape is a closed ring shape.

14. An electrical connector slide member as in claim 12 wherein the general ring shape has a general oval shape.

15. An electrical connector slide member as in claim 12 wherein a rear top side of the main housing section has a first recess adapted to receive a portion of a connector position assurance (CPA) member therein.

16. An electrical connector slide member as in claim 15 wherein a front bottom side of the main housing section has a second recess adapted to receive a portion of a mating electrical connector therein.

17. An electrical connector slide member as in claim 12 further comprising sliding interlock features extending into the central channel from the top wall of the main housing section, wherein the sliding interlock features comprise two general L shaped legs extending in opposite directions.

18. An electrical connector slide member as in claim 17 wherein one of the L shaped legs has the rack section thereon.

19. An electrical connector comprising:

a housing;

electrical contacts connected to the housing;

a slide member as in claim 12 slidably mounted to the housing;

a cam member rotatably mounted to the housing, wherein the cam member comprises a taming surface adapted to contact a cam portion of a mating electrical connector, and wherein the cam member comprises a gear section with teeth engaging the teeth of the slide member; and a connector position assurance (CPA) member movably connected to the housing, wherein the CPA member is adapted to directly engage the cam member for preventing the cam member for rotating relative to the housing.

20. An electrical connector comprising:

a housing adapted to receive a portion of a mating electrical connector;

a slide movably mounted to the housing, wherein the slide comprises a section with teeth, and wherein the slide is adapted to be moved from a retracted position on the housing to an extended position on the housing around portion of the mating electrical connector; and a cam member rotatably mounted to the housing, wherein the cam member comprises a caming surface adapted to contact a cam portion of the mating electrical connector, wherein the cam member comprises a gear section with teeth engaging the teeth of the slide, and wherein the cam member comprises a connector position assurance (CPA) slot adapted to receive a portion of a CPA member in the CPA slot.

* * * * *